US009082416B2

(12) United States Patent
Krishnan et al.

(10) Patent No.: US 9,082,416 B2
(45) **Date of Patent: *Jul. 14, 2015**

(54) ESTIMATING A PITCH LAG

(75) Inventors: Venkatesh Krishnan, San Diego, CA (US); Stephane Pierre Villette, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 198 days.

This patent is subject to a terminal disclaimer.

(21) Appl. No.: 13/228,136

(22) Filed: Sep. 8, 2011

(65) Prior Publication Data

US 2012/0072209 A1 Mar. 22, 2012

Related U.S. Application Data

(60) Provisional application No. 61/383,692, filed on Sep. 16, 2010.

(51) Int. Cl.
*G10L 21/00* (2013.01)
*G10L 25/90* (2013.01)
(Continued)

(52) U.S. Cl.
CPC ..... *G10L 25/90* (2013.01); *G10L 19/097* (2013.01)

(58) Field of Classification Search
CPC ..... G10L 13/08; G10L 15/265; G10L 25/90; G10L 25/93; G10L 21/04; G10L 13/04; G10L 19/008; G10L 19/06; G10L 19/12; G10L 21/0208; G10L 19/10; G10L 19/0212; G10L 19/005; G10L 15/187; G10L 15/20; G10L 15/00; G10L 15/02; G10L 15/144; G10L 13/07; G10L 15/22; G11B 27/034; H05K 999/99; G11C 2207/16; H04B 1/665
USPC ..... 704/200–230, 500–504
See application file for complete search history.

(56) References Cited

U.S. PATENT DOCUMENTS 4,074,069 A * 2/1978 Tokura et al. ..... 704/208
4,390,747 A * 6/1983 Sampei et al. ..... 704/217
(Continued)

FOREIGN PATENT DOCUMENTS

CN 1441950 A 9/2003
EP 1770687 A1 4/2007
(Continued)

OTHER PUBLICATIONS

Price et al., "Extension of covariance selection mathematics." Lond. (1972), 35, 485, Ann. Hum, Genet.*
(Continued)

*Primary Examiner* — Pierre-Louis Desir
*Assistant Examiner* — Anne Thomas-Homescu
(74) *Attorney, Agent, or Firm* — Austin Rapp & Hardman

(57) ABSTRACT

An electronic device for estimating a pitch lag is described. The electronic device includes a processor and executable instructions stored in memory that is in electronic communication with the processor. The electronic device obtains a current frame. The electronic device also obtains a residual signal based on the current frame. The electronic device additionally determines a set of peak locations based on the residual signal. Furthermore, the electronic device obtains a set of pitch lag candidates based on the set of peak locations. The electronic device also estimates a pitch lag based on the set of pitch lag candidates.

50 Claims, 14 Drawing Sheets

(51) Int. Cl.

| | |
|---|---|
| ***G10L 25/93*** | (2013.01) |
| ***G10L 19/06*** | (2013.01) |
| ***G10L 19/12*** | (2013.01) |
| ***G10L 21/02*** | (2013.01) |
| ***G10L 19/02*** | (2013.01) |
| ***G10L 19/00*** | (2013.01) |
| ***G10L 21/04*** | (2013.01) |
| *G10L 19/097* | (2013.01) |

(56) References Cited

U.S. PATENT DOCUMENTS

| | | | | |
|---|---|---|---|---|
| 4,561,102 | A * | 12/1985 | Prezas | 704/207 |
| 5,105,464 | A * | 4/1992 | Zinser | 704/219 |
| 5,353,372 | A * | 10/1994 | Cook et al. | 704/207 |
| 5,774,836 | A * | 6/1998 | Bartkowiak et al. | 704/207 |
| 5,774,837 | A * | 6/1998 | Yeldener et al. | 704/208 |
| 5,778,338 | A * | 7/1998 | Jacobs et al. | 704/223 |
| 5,781,880 | A | 7/1998 | Su | |
| 5,812,967 | A * | 9/1998 | Ponceleon et al. | 704/207 |
| 5,946,649 | A * | 8/1999 | Javkin et al. | 704/203 |
| 5,946,650 | A * | 8/1999 | Wei | 704/207 |
| 6,012,023 | A * | 1/2000 | Iijima et al. | 704/207 |
| 6,014,622 | A | 1/2000 | Su et al. | |
| 6,073,092 | A * | 6/2000 | Kwon | 704/219 |
| 6,151,571 | A * | 11/2000 | Pertrushin | 704/209 |
| 6,226,604 | B1 | 5/2001 | Ehara et al. | |
| 6,226,606 | B1 * | 5/2001 | Acero et al. | 704/218 |
| 6,233,550 | B1 | 5/2001 | Gersho et al. | |
| 6,351,730 | B2 * | 2/2002 | Chen | 704/229 |
| 6,470,308 | B1 * | 10/2002 | Ma et al. | 704/201 |
| 6,475,245 | B2 | 11/2002 | Gersho et al. | |
| 6,757,654 | B1 * | 6/2004 | Westerlund et al. | 704/262 |
| 6,763,339 | B2 * | 7/2004 | Fu et al. | 706/22 |
| 6,865,529 | B2 * | 3/2005 | Brandel et al. | 704/207 |
| 6,879,955 | B2 * | 4/2005 | Rao | 704/241 |
| 6,917,912 | B2 * | 7/2005 | Chang et al. | 704/207 |
| 7,016,850 | B1 * | 3/2006 | Cox et al. | 704/503 |
| 7,660,718 | B2 * | 2/2010 | Padhi et al. | 704/268 |
| 7,860,708 | B2 * | 12/2010 | Kim | 704/207 |
| 7,895,033 | B2 * | 2/2011 | Joublin et al. | 704/200 |
| 7,933,767 | B2 * | 4/2011 | Ojanpera | 704/207 |
| 8,050,910 | B2 * | 11/2011 | Joublin et al. | 704/207 |
| 8,073,688 | B2 * | 12/2011 | Yoshioka et al. | 704/225 |
| 8,185,384 | B2 * | 5/2012 | Sun et al. | 704/207 |
| 8,214,201 | B2 * | 7/2012 | Sun | 704/207 |
| 8,392,178 | B2 * | 3/2013 | Vos | 704/207 |
| 8,620,672 | B2 * | 12/2013 | Visser et al. | 704/500 |
| 8,645,128 | B1 * | 2/2014 | Agiomyrgiannakis | 704/207 |
| 8,990,081 | B2 * | 3/2015 | Lu et al. | 704/236 |
| 2001/0001142 | A1 | 5/2001 | Ehara et al. | |
| 2002/0123888 | A1 * | 9/2002 | Gao | 704/223 |
| 2004/0158462 | A1 * | 8/2004 | Rutledge et al. | 704/207 |
| 2005/0058145 | A1 * | 3/2005 | Florencio et al. | 370/412 |
| 2005/0091045 | A1 * | 4/2005 | Oh | 704/207 |
| 2007/0136052 | A1 * | 6/2007 | Gao et al. | 704/207 |
| 2007/0255559 | A1 * | 11/2007 | Gao et al. | 704/225 |
| 2009/0063139 | A1 * | 3/2009 | Tammi et al. | 704/207 |
| 2009/0119098 | A1 * | 5/2009 | Zhan et al. | 704/219 |
| 2009/0204396 | A1 * | 8/2009 | Xu et al. | 704/207 |
| 2009/0299758 | A1 * | 12/2009 | Cox et al. | 704/503 |
| 2009/0319261 | A1 * | 12/2009 | Gupta et al. | 704/207 |
| 2009/0326930 | A1 | 12/2009 | Kawashima et al. | |
| 2010/0010810 | A1 * | 1/2010 | Morii | 704/207 |
| 2010/0106488 | A1 * | 4/2010 | Ehara | 704/207 |
| 2010/0125452 | A1 | 5/2010 | Sun | |
| 2010/0185442 | A1 * | 7/2010 | Sato et al. | 704/222 |
| 2010/0241424 | A1 * | 9/2010 | Gao | 704/207 |
| 2010/0305953 | A1 * | 12/2010 | Susan et al. | 704/500 |
| 2011/0035213 | A1 * | 2/2011 | Malenovsky et al. | 704/208 |
| 2011/0077940 | A1 * | 3/2011 | Vos et al. | 704/229 |
| 2011/0251842 | A1 * | 10/2011 | Cook et al. | 704/207 |
| 2013/0262100 | A1 * | 10/2013 | Vos | 704/226 |
| 2013/0282368 | A1 * | 10/2013 | Choo et al. | 704/219 |

FOREIGN PATENT DOCUMENTS

| | | | |
|---|---|---|---|
| GB | 2400003 | A | 9/2004 |
| JP | 1097294 | A | 4/1989 |
| JP | 2004109803 | A | 4/2004 |
| WO | WO-2008007699 | A1 | 1/2008 |
| WO | WO-2009155569 | A1 | 12/2009 |

OTHER PUBLICATIONS

Ojala et al., "A Novel Pitch-Lag Search Method Using Adaptive Weighting and Median Filtering." 1999 IEEE.*

YH Kwon et al., Simplified Pitch Detection Algorithm of Mixed Speech Signals, ISCAS 2000, IEEE International Symposium on Circuits and Systems, May 28-31, 2000, Geneva, Switzerland.*

D. Eberly, "Derivative Approximation by Finite Differences", Last Modified, Mar. 2, 2008.*

Pettigrew, R. and Cuperman, V., "Hybrid Backward Adaptive Pitch Prediction for Low-Delay Vector Excitation Coding", The Springer International Series in Engineering and Computer Science, vol. 114, 1991, pp. 57-66.*

Rooker, T., "Formant estimation from a spectral slice using neural networks", Aug. 1990.*

Ding et al., "How to track pitch pulses in LP residual?—joint time-frequency distribution approach", IEEE Pacific Rim Conference on Communications, Computers and Signal Processing, Victoria, BC, Canada, Aug. 26-28, 2001; [IEEE Pacific Rim Conference on Communications, Computers and Signal Processing Pacrim], New York, NY : IEEE, us, vol. 1, Aug. 26, 2001, pp. 43-46, XP010560283, DOI: 10.1109/PACRIM. 2001.953518 ISBN: 978-0-7803-7080-7.

International Search Report and Written Opinion—PCT/US2011/051046—ISA/EPO—Nov. 9, 2011.

Ojala, et al., "A Novel Pitch-Lag Search Method Using Adaptive Weighting and Median Filtering," 1999 IEEE Workshop on Speech Coding Proceedings, 1999, pp. 114-116.

* cited by examiner

600

ESTIMATING A PITCH LAG

RELATED APPLICATIONS

This application is related to and claims priority from U.S. Provisional Patent Application Ser. No. 61/383,692 filed Sep. 16, 2010, for "ESTIMATING A PITCH LAG."

TECHNICAL FIELD

The present disclosure relates generally to signal processing. More specifically, the present disclosure relates to estimating a pitch lag.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform functions faster, more efficiently or with higher quality are often sought after.

Some electronic devices (e.g., cellular phones, smart phones, computers, etc.) use speech signals. These electronic devices may encode speech signals for storage or transmission. For example, a cellular phone captures a user's voice or speech using a microphone. For instance, the cellular phone converts an acoustic signal into an electronic signal using the microphone. This electronic signal may then be formatted for transmission to another device (e.g., cellular phone, smart phone, computer, etc.) or for storage.

Transmitting or sending an uncompressed speech signal may be costly in terms of bandwidth and/or storage resources, for example. Some schemes exist that attempt to represent a speech signal more efficiently (e.g., using less data). However, these schemes may not represent some parts of a speech signal well, resulting in degraded performance. As can be understood from the foregoing discussion, systems and methods that improve speech signal coding may be beneficial.

SUMMARY

An electronic device for estimating a pitch lag is disclosed. The electronic device includes a processor and instructions stored in memory that is in electronic communication with the processor. The electronic device obtains a current frame. The electronic device also obtains a residual signal based on the current frame. The electronic device additionally determines a set of peak locations based on the residual signal. The electronic device further obtains a set of pitch lag candidates based on the set of peak locations. The electronic device also estimates a pitch lag based on the set of pitch lag candidates. Obtaining the residual signal may be further based on the set of quantized linear prediction coefficients. Obtaining the set of pitch lag candidates may include arranging the set of peak locations in increasing order to yield an ordered set of peak locations and calculating a distance between consecutive peak location pairs in the ordered set of peak locations.

Determining a set of peak locations may include calculating an envelope signal based on the absolute value of samples of the residual signal and a window signal. Determining a set of peak locations may also include calculating a first gradient signal based on a difference between the envelope signal and a time-shifted version of the envelope signal. Determining a set of peak locations may additionally include calculating a second gradient signal based on the difference between the first gradient signal and a time-shifted version of the first gradient signal. Determining a set of peak locations may further include selecting a first set of location indices where a second gradient signal value falls below a first threshold. Determining a set of peak locations may also include determining a second set of location indices from the first set of location indices by eliminating location indices where an envelope value falls below a second threshold relative to a largest value in the envelope. Determining a set of peak locations may also include determining a third set of location indices from the second set of location indices by eliminating location indices that do not meet a difference threshold with respect to neighboring location indices.

The electronic device may also perform a linear prediction analysis using the current frame and a signal prior to the current frame to obtain a set of linear prediction coefficients. The electronic device may also determine a set of quantized linear prediction coefficients based on the set of linear prediction coefficients. The pitch lag may be estimated based on the set of pitch lag candidates and the set of confidence measures using an iterative pruning algorithm.

The electronic device may also calculate a set of confidence measures corresponding to the set of pitch lag candidates. Calculating the set of confidence measures corresponding to the set of pitch lag candidates may be based on a signal envelope and consecutive peak location pairs in an ordered set of the peak locations. Calculating the set of confidence measures may include, for each pair of peak locations in the ordered set of the peak locations, selecting a first signal buffer based on a range around a first peak location in a pair of peak locations and selecting a second signal buffer based on a range around a second peak location in the pair of peak locations. Calculating the set of confidence measures may also include, for each pair of peak locations in the ordered set of the peak locations, calculating a normalized cross-correlation between the first signal buffer and the second signal buffer and adding the normalized cross-correlation to the set of confidence measures.

The electronic device may also add a first approximation pitch lag value that is calculated based on the residual signal of the current frame to the set of pitch lag candidates and add a first pitch gain corresponding to the first approximation pitch lag value to the set of confidence measures. The first approximation pitch lag value may be estimated and the first pitch gain may be estimated by estimating an autocorrelation value based on the residual signal of the current frame and searching the autocorrelation value within a range of locations for a maximum. The first approximation pitch lag value may further be estimated and the first pitch gain may also be estimated by setting the first approximation pitch lag value as a location at which the maximum occurs and setting the first pitch gain value as a normalized autocorrelation at the first approximation pitch lag value.

The electronic device may also add a second approximation pitch lag value that is calculated based on a residual signal of a previous frame to the set of pitch lag candidates and may add a second pitch gain corresponding to the second approximation pitch lag value to the set of confidence measures. The electronic device may also transmit the pitch lag. The electronic device may be a wireless communication device.

The second approximation pitch lag value may be estimated and the second pitch gain may be estimated by estimating an autocorrelation value based on the residual signal of the previous frame and searching the autocorrelation value within a range of locations for a maximum. The second approximation pitch lag value may further be estimated and the second pitch gain may further be estimated by setting the second approximation pitch lag value as the location at which the maximum occurs and setting the pitch gain value as a normalized autocorrelation at the second approximation pitch lag value.

Estimating the pitch lag based on the set of pitch lag candidates and the set of confidence measures using an iterative pruning algorithm may include calculating a weighted mean using the set of pitch lag candidates and the set of confidence measures and determining a pitch lag candidate that is farthest from the weighted mean in the set of pitch lag candidates. Estimating the pitch lag based on the set of pitch lag candidates and the set of confidence measures using an iterative pruning algorithm may further include removing the pitch lag candidate that is farthest from the weighted mean from the set of pitch lag candidates and removing a confidence measure corresponding to the pitch lag candidate that is farthest from the weighted mean from the set of confidence measures. Estimating the pitch lag based on the set of pitch lag candidates and the set of confidence measures using an iterative pruning algorithm may further include determining whether a remaining number of pitch lag candidates is equal to a designated number and determining the pitch lag based on one or more remaining pitch lag candidates if the remaining number of pitch lag candidates is equal to the designated number. The electronic device may also iterate if the remaining number of pitch lag candidates is not equal to the designated number.

Calculating the weighted mean may be accomplished according to an equation $$M_W = \frac{\sum_{i=1}^{L} d_i c_i}{\sum_{i=1}^{L} c_i}.$$

$M_w$ may be the weighted mean, L may be a number of pitch lag candidates, $\{d_i\}$ may be the set of pitch lag candidates and $\{c_i\}$ may be the set of confidence measures.

Determining a pitch lag candidate that is farthest from the weighted mean in the set of pitch lag candidates may be accomplished by finding a $d_k$ such that $|M_w-d_k|>|M_w-d_i|$ for all i, where $i\neq k$. $d_k$ may be the pitch lag candidate that is farthest from the weighted mean, $M_w$ may be the weighted mean, $\{d_i\}$ may be the set of pitch lag candidates and i may be an index number.

Another electronic device for estimating a pitch lag is also disclosed. The electronic device includes a processor and instructions stored in memory that is in electronic communication with the processor. The electronic device obtains a speech signal. The electronic device also obtains a set of pitch lag candidates based on the speech signal. The electronic device further determines a set of confidence measures corresponding to the set of pitch lag candidates. The electronic device additionally estimates a pitch lag based on the set of pitch lag candidates and the set of confidence measures using an iterative pruning algorithm.

Estimating the pitch lag based on the set of pitch lag candidates and the set of confidence measures using an iterative pruning algorithm may include calculating a weighted mean using the set of pitch lag candidates and the set of confidence measures and determining a pitch lag candidate that is farthest from a weighted mean in the set of pitch lag candidates. Estimating the pitch lag based on the set of pitch lag candidates and the set of confidence measures using an iterative pruning algorithm may further include removing a pitch lag candidate that is farthest from the weighted mean from the set of pitch lag candidates and removing a confidence measure corresponding to the pitch lag candidate that is farthest from the weighted mean from the set of confidence measures. Estimating the pitch lag based on the set of pitch lag candidates and the set of confidence measures using an iterative pruning algorithm may additionally include determining whether a remaining number of pitch lag candidates is equal to a designated number and determining the pitch lag based on one or more remaining pitch lag candidates if the remaining number of pitch lag candidates is equal to the designated number.

A method for estimating a pitch lag on an electronic device is also disclosed. The method includes obtaining a current frame. The method also includes obtaining a residual signal based on the current frame. The method further includes determining a set of peak locations based on the residual signal. The method additionally includes obtaining a set of pitch lag candidates based on the set of peak locations. The method also includes estimating a pitch lag based on the set of pitch lag candidates.

Another method for estimating a pitch lag on an electronic device is also disclosed. The method includes obtaining a speech signal. The method also includes obtaining a set of pitch lag candidates based on the speech signal. The method further includes determining a set of confidence measures corresponding to the set of pitch lag candidates. The method additionally includes estimating a pitch lag based on the set of pitch lag candidates and the set of confidence measures using an iterative pruning algorithm.

A computer-program product for estimating a pitch lag is also disclosed. The computer-program produce includes a non-transitory tangible computer-readable medium with instructions. The instructions include code for causing an electronic device to obtain a current frame. The instructions also include code for causing the electronic device to obtain a residual signal based on the current frame. The instructions further include code for causing the electronic device to determine a set of peak locations based on the residual signal. The instructions additionally include code for causing the electronic device to obtain a set of pitch lag candidates based on the set of peak locations. The instructions also include code for causing the electronic device to estimate a pitch lag based on the set of pitch lag candidates.

Another computer-program product for estimating a pitch lag is also disclosed. The computer-program product includes a non-transitory tangible computer-readable medium with instructions. The instructions include code for causing an electronic device to obtain a speech signal. The instructions also include code for causing the electronic device to obtain a set of pitch lag candidates based on the speech signal. The instructions further include code for causing the electronic device to determine a set of confidence measures corresponding to the set of pitch lag candidates. The instructions additionally include code for causing the electronic device to estimate a pitch lag based on the set of pitch lag candidates and the set of confidence measures using an iterative pruning algorithm.

An apparatus for estimating a pitch lag is also disclosed. The apparatus includes means for obtaining a current frame. The apparatus also includes means for obtaining a residual signal based on the current frame. The apparatus further includes means for determining a set of peak locations based on the residual signal. The apparatus additionally includes means for obtaining a set of pitch lag candidates based on the set of peak locations. The apparatus also includes means for estimating a pitch lag based on the set of pitch lag candidates.

Another apparatus for estimating a pitch lag is also disclosed. The apparatus includes means for obtaining a speech signal. The apparatus also includes means for obtaining a set of pitch lag candidates based on the speech signal. The apparatus further includes means for determining a set of confidence measures corresponding to the set of pitch lag candidates. The apparatus additionally includes means for estimating a pitch lag based on the set of pitch lag candidates and the set of confidence measures using an iterative pruning algorithm.

DETAILED DESCRIPTION

Figure 1:
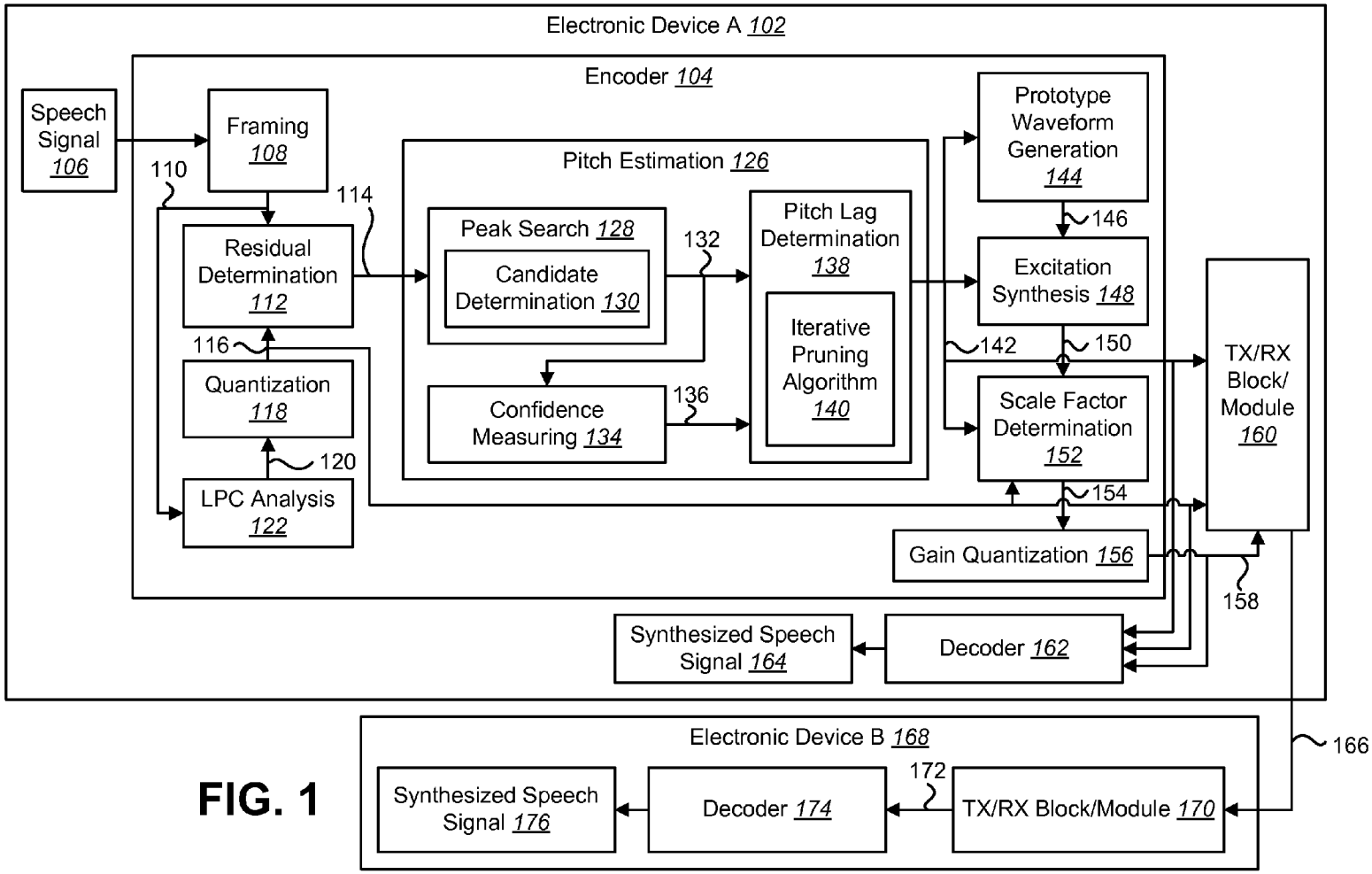
FIG. 1 is a block diagram illustrating one configuration of an electronic device in which systems and methods for estimating a pitch lag may be implemented.

The systems and methods disclosed herein may be applied to a variety of devices, such as electronic devices. Examples of electronic devices include voice recorders, video cameras, audio players (e.g., Moving Picture Experts Group-1 (MPEG-1) or MPEG-2 Audio Layer 3 (MP3) players), video players, audio recorders, desktop computers/laptop computers, personal digital assistants (PDAs), gaming systems, etc. One kind of electronic device is a communication device, which may communicate with another device. Examples of communication devices include telephones, laptop computers, desktop computers, cellular phones, smartphones, wireless or wired modems, e-readers, tablet devices, gaming systems, cellular telephone base stations or nodes, access points, wireless gateways and wireless routers.

A communication device may operate in accordance with certain industry standards, such as International Telecommunication Union (ITU) standards and/or Institute of Electrical and Electronics Engineers (IEEE) standards (e.g., Wireless Fidelity or "Wi-Fi" standards such as 802.11a, 802.11b, 802.11g, 802.11n and/or 802.11ac). Other examples of standards that a communication device may comply with include IEEE 802.16 (e.g., Worldwide Interoperability for Microwave Access or "WiMAX"), Third Generation Partnership Project (3GPP), 3GPP Long Term Evolution (LTE), Global System for Mobile Telecommunications (GSM) and others (where a communication device may be referred to as a User Equipment (UE), NodeB, evolved NodeB (eNB), mobile device, mobile station, subscriber station, remote station, access terminal, mobile terminal, terminal, user terminal, subscriber unit, etc., for example). While some of the systems and methods disclosed herein may be described in terms of one or more standards, this should not limit the scope of the disclosure, as the systems and methods may be applicable to many systems and/or standards.

It should be noted that some communication devices may communicate wirelessly and/or may communicate using a wired connection or link. For example, some communication devices may communicate with other devices using an Ethernet protocol. The systems and methods disclosed herein may be applied to communication devices that communicate wirelessly and/or that communicate using a wired connection or link. In one configuration, the systems and methods disclosed herein may be applied to a communication device that communicates with another device using a satellite.

The systems and methods disclosed herein may be applied to one example of a communication system that is described as follows. In this example, the systems and methods disclosed herein may provide low bitrate (e.g., 2 kilobits per second (Kbps)) speech encoding for geo-mobile satellite air interface (GMSA) satellite communication. More specifically, the systems and methods disclosed herein may be used in integrated satellite and mobile communication networks. Such networks may provide seamless, transparent, interoperable and ubiquitous wireless coverage. Satellite-based service may be used for communications in remote locations where terrestrial coverage is unavailable. For example, such service may be useful for man-made or natural disasters, broadcasting and/or fleet management and asset tracking. L and/or S-band (wireless) spectrum may be used.

In one configuration, a forward link may use 1× Evolution Data Optimized (EV-DO) Rev A air interface as the base technology for the over-the-air satellite link A reverse link may use frequency-division multiplexing (FDM). For example, a 1.25 megahertz (MHz) block of reverse link spectrum may be divided into 192 narrowband frequency channels, each with bandwidth of 6.4 kilohertz (kHz). The reverse link data rate may be limited. This may present a need for low bit rate encoding. In some cases, for example, a channel may be able to only support 2.4 Kbps. However, with better channel conditions, 2 FDM channels may be available, possibly providing a 4.8 kbps transmission.

On the reverse link, for example, a low bit rate speech encoder may be used. This may allow a fixed rate of 2 Kbps for active speech for a single FDM channel assignment on the reverse link. In one configuration, the reverse link uses a ¼ convolution coder for basic channel encoding.

In some configurations, the systems and methods disclosed herein may be used in addition to other encoding modes. For example, the systems and methods disclosed herein may be used in addition to or alternatively from quarter rate voiced coding using prototype pitch-period waveform interpolation (PPPWI). In PPPWI, a prototype waveform may be used to generate interpolated waveforms that may replace actual waveforms, allowing a reduced number of samples to produce a reconstructed signal. PPPWI may be available at full rate or quarter rate and/or may produce a time-synchronous output, for example. Furthermore, quantization may be performed in the frequency domain in PPPWI. QQQ may be used in a voiced encoding mode (instead of FQQ (effective half rate), for example). QQQ is a coding pattern that encodes three consecutive voiced frames using quarter rate prototype pitch period waveform interpolation (QPPP-WI) at 40 bits per frame (2 kilobits per second (kbps) effectively). FQQ is a coding pattern in which three consecutive voiced frames are encoded using full rate prototype pitch period (PPP), quarter rate prototype pitch period (QPPP) and QPPP respectively. This may achieve an average rate of 4 kbps. The latter may not be used in a 2 kbps vocoder. It should be noted that quarter rate prototype pitch period (QPPP) may be used in a modified fashion, with no delta encoding of amplitudes of prototype representation in the frequency domain and with 13-bit line spectral frequency (LSF) quantization. In one configuration, QPPP may use 13 bits for LSFs, 12 bits for a prototype waveform amplitude, six bits for prototype waveform power, seven bits for pitch lag and two bits for mode, resulting in 40 bits total.

In particular, the systems and method disclosed herein may be used for a transient encoding mode (which may provide seed needed for QPPP). This transient encoding mode (in a 2 Kbps vocoder, for example) may use a unified model for coding up transients, down transients and voiced transients. Although the systems and methods disclosed herein may be applied in particular to a transient encoding mode, the transient encoding mode is not the only context in which these systems and methods may be applied. They may be additionally or alternatively applied to other encoding modes The systems and methods disclosed herein describe performing pitch estimation. In some configurations, estimating a pitch lag may be accomplished in part by iteratively pruning candidate pitch values that include inter-peak distances in Linear Predictive Coding (LPC) residuals. Accurate pitch estimation may be needed to produce good coded speech quality in very low bit rate vocoders. Some traditional pitch estimation algorithms estimate the pitch from a frame of speech signal and/or a corresponding LPC residual using long-term statistics of the signal. Such an estimate is often unreliable for non-stationary and transient frames. In other words, this may not give an accurate estimate for non-stationary transient speech frames.

The systems and methods disclosed herein may estimate pitch more reliably by using short-time (e.g., localized) characteristics in speech frames and/or by using an iterative algorithm to select an ideal (e.g., the best available) pitch value among several candidates. This may improve speech quality in low bit rate vocoders, thereby improving recorded or transmitted speech quality, for example. More specifically, the systems and methods disclosed herein may use an estimation algorithm that provides a more accurate estimate of the pitch than traditional techniques and therefore results in improved speech quality for low bit rate encoding modes in a vocoder.

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

FIG. 1 is a block diagram illustrating one configuration of an electronic device 102 in which systems and methods for estimating a pitch lag may be implemented. Additionally or alternatively, systems and methods for decoding a speech signal may be implemented in the electronic device 102. Electronic device A 102 may include an encoder 104. One example of the encoder 104 is a Linear Predictive Coding (LPC) encoder. The encoder 104 may be used by electronic device A 102 to encode a speech signal 106. For instance, the encoder 104 encodes speech signals 106 into a "compressed" format by estimating or generating a set of parameters that may be used to synthesize the speech signal. In one configuration, such parameters may represent estimates of pitch (e.g., frequency), amplitude and formants (e.g., resonances) that can be used to synthesize the speech signal 106. The encoder 104 may include a pitch estimation block/module 126 that estimates a pitch lag according to the systems and methods disclosed herein. As used herein, the term "block/module" may be used to indicate that a particular element may be implemented in hardware, software or a combination of both. It should be noted that the pitch estimation block/module 126 may be implemented in a variety of ways. For example, the pitch estimation block/module 126 may comprise a peak search block/module 128, a confidence measuring block/module 134 and/or a pitch lag determination block/module 138. In other configurations, one or more of the block/modules illustrated as being included within the pitch estimation block/module 126 may be omitted and/or replaced by other blocks/modules. Additionally or alternatively, the pitch estimation block/module 126 may be defined as including other blocks/modules, such as the Linear Predictive Coding (LPC) analysis block/module 122.

Electronic device A 102 may obtain a speech signal 106. In one configuration, electronic device A 102 obtains the speech signal 106 by capturing and/or sampling an acoustic signal using a microphone. In another configuration, electronic device A 102 receives the speech signal 106 from another device (e.g., a Bluetooth headset, a Universal Serial Bus (USB) drive, a Secure Digital (SD) card, a network interface, wireless microphone, etc.). The speech signal 106 may be provided to a framing block/module 108.

Electronic device A 102 may segment the speech signal 106 into one or more frames 110 using the framing block/module 108. For instance, a frame 110 may include a particular number of speech signal 106 samples and/or include an amount of time (e.g., 10-20 milliseconds) of the speech signal 106. When the speech signal 106 is segmented into frames 110, the frames 110 may be classified according to the signal that they contain. For example, a frame 110 may be a voiced frame, an unvoiced frame, a silent frame or a transient frame. The systems and methods disclosed herein may be used to estimate a pitch lag in a frame 110 (e.g., transient frame, voiced frame, etc.).

A transient frame, for example, may be situated on the boundary between one speech class and another speech class. For example, a speech signal 106 may transition from an unvoiced sound (e.g., f, s, sh, th, etc.) to a voiced sound (e.g., a, e, i, o, u, etc.). Some transient types include up transients (when transitioning from an unvoiced to a voiced part of a speech signal 106, for example), plosives, voiced transients (e.g., Linear Predictive Coding (LPC) changes and pitch lag variations) and down transients (when transitioning from a voiced to an unvoiced or silent part of a speech signal 106 such as word endings, for example). A frame 110 in-between the two speech classes may be a transient frame. The systems and methods disclosed herein may be beneficially applied to transient frames, since traditional approaches may not provide accurate pitch lag estimates in transient frames. It should be noted, however, that the systems and methods disclosed herein may be applied to other kinds of frames.

The encoder 104 may use a linear predictive coding (LPC) analysis block/module 122 to perform a linear prediction analysis (e.g., LPC analysis) on a frame 110. It should be noted that the LPC analysis block/module 122 may additionally or alternatively use one or more samples from other frames 110 (from a previous frame 110, for example). The LPC analysis block/module 122 may produce one or more LPC coefficients 120. The LPC coefficients 120 may be provided to a quantization block/module 118, which may produce one or more quantized LPC coefficients 116. The quantized LPC coefficients 116 and one or more samples from one or more frames 110 may be provided to a residual determination block/module 112, which may be used to determine a residual signal 114. For example, a residual signal 114 may include a frame 110 of the speech signal 106 that has had the formants or the effects of the formants removed from the speech signal 106. The residual signal 114 may be provided to a pitch estimation block/module 126.

The encoder 104 may include a pitch estimation block/module 126. In the example illustrated in FIG. 1, the pitch estimation block/module 126 includes a peak search 128 block/module, a confidence measuring block/module 134 and a pitch lag determination block/module 138. However, the peak search block/module 128 and/or the confidence measuring block/module 134 may be optional, and may be replaced with one or more other blocks/modules that determine one or more pitch (e.g., pitch lag) candidates 132 and/or confidence measurements 136. As illustrated in FIG. 1, the pitch lag determination block/module 138 may make use of an iterative pruning algorithm 140. However, the iterative pruning algorithm 140 may be optional, and may be omitted in some configurations of the systems and methods disclosed herein. In other words, a pitch lag determination block/module 138 may determine a pitch lag without using an iterative pruning algorithm 140 in some configurations and may use some other approach or algorithm, such as a smoothing or averaging algorithm to determine a pitch lag 142, for example.

The peak search block/module 128 may search for peaks in the residual signal 114. In other words, the encoder 104 may search for peaks (e.g., regions of high energy) in the residual signal 114. These peaks may be identified to obtain a list or set of peaks. Peak locations in the list or set of peaks may be specified in terms of sample number and/or time, for example. More detail on obtaining the list or set of peaks is given below.

The peak search block/module 128 may include a candidate determination block/module 130. The candidate determination block/module 130 may use the set of peaks in order to determine one or more candidate pitch lags 132. A "pitch lag" may be a "distance" between two successive pitch spikes in a frame 110. A pitch lag may be specified in a number of samples and/or an amount of time, for example. In one configuration, the peak search block/module 128 may determine the distances between peaks in order to determine the pitch lag candidates 132. In a very steady voice or speech signal, the pitch lag may remain nearly constant.

Some traditional methods for estimating the pitch lag use autocorrelation. In those approaches, the LPC residual is slid against itself to do a correlation. Whichever correlation or pitch lag has the largest autocorrelation value may be determined to be the pitch of the frame in those approaches. Those approaches may work when the speech frame is very steady. However, there are other frames where the pitch structure may not be very steady, such as in a transient frame. Even when the speech frame is steady, the traditional approaches may not provide a very accurate pitch estimate due to noise in the system. Noise may reduce how "peaky" the residual is. In such a case, for example, traditional approaches may determine a pitch estimate that is not very accurate.

The peak search block/module 128 may obtain a set of pitch lag candidates 132 using a correlation approach. For example, a set of candidate pitch lags 132 may be first determined by the candidate determination block/module 130. Then, a set of confidence measures 136 corresponding to the set of candidate pitch lags may be determined by the confidence measuring block/module 134 based on the set of candidate pitch lags 132. More specifically, a first set may be a set of pitch lag candidates 132 and a second set may be a set of confidence measures 136 for each of the pitch lag candidates 132. Thus, for example, a first confidence measure or value may correspond to a first pitch lag candidate and so on. Thus, a set of pitch lag candidates 132 and a set of confidence measures 136 may be may be "built" or determined. The set of confidence measures 136 may be used to improve the accuracy of the estimated pitch lag 142. In one configuration, the set of confidence measures 136 may be a set of correlations where each value may be (in basic terms) a correlation at a pitch lag corresponding to a pitch lag candidate. In other words, the correlation coefficient for each particular pitch lag may constitute the confidence measure for each of the pitch lag candidate 132 distances.

The set of pitch lag candidates 132 and/or the set of confidence measures 136 may be provided to a pitch lag determination block/module 138. The pitch lag determination block/module 138 may determine a pitch lag 142 based on one or more pitch lag candidates 132. In some configurations, the pitch lag determination block/module 138 may determine a pitch lag 142 based on one or more confidence measures 136 (in addition to the one or more pitch lag candidates 132). For example, the pitch lag determination block/module may use an iterative pruning algorithm 140 to select one of the pitch lag values. More detail on the iterative pruning algorithm 140 is given below. The selected pitch lag 142 value may be an estimate of the "true" pitch lag.

In other configurations, the pitch lag determination block/module 138 may use some other approach to determine a pitch lag 142. For example, the pitch lag determination block/module 138 may use an averaging or smoothing algorithm instead of or in addition to the iterative pruning algorithm 140.

The pitch lag 142 determined by the pitch lag determination block/module 138 may be provided to an excitation synthesis block/module 148 and a scale factor determination block/module 152. The excitation synthesis block/module 148 may generate or synthesize an excitation 150 based on the pitch lag 142 and a waveform 146 provided by a prototype waveform generation block/module 144. In one configuration, the prototype waveform generation block/module 144 may generate the waveform 146 based on the pitch lag 142. The excitation 150, the pitch lag 142 and/or the quantized LPC coefficients 116 may be provided to a scale factor determination block/module 152, which may produce a set of gains 154 based on the excitation 150, the pitch lag 142 and/or the quantized LPC coefficients 116. The set of gains 154 may be provided to a gain quantization block/module 156 that quantizes the set of gains 154 to produce a set of quantized gains 158.

The pitch lag 142, the quantized LPC coefficients 116 and/or the quantized gains 158 may be referred to as an encoded speech signal. The encoded speech signal may be decoded in order to produce a synthesized speech signal. The pitch lag 142, the quantized LPC coefficients 116 and/or the quantized gains 158 (e.g., the encoded speech signal) may be transmitted to another device, stored and/or decoded.

In one configuration, electronic device A 102 may include a transmit (TX) and/or receive (RX) block/module 160. The pitch lag 142, the quantized LPC coefficients 116 and/or the quantized gains 158 may be provided to the TX/RX block/module 160. The TX/RX block/module 160 may format the pitch lag 142, the quantized LPC coefficients 116 and/or the quantized gains 158 into a format suitable for transmission. For example, the TX/RX block/module 160 may encode, modulate, scale (e.g., amplify) and/or otherwise format the pitch lag 142, the quantized LPC coefficients 116 and/or the quantized gains 158 as one or more messages 166. The TX/RX block/module 160 may transmit the one or more messages 166 to another device, such as electronic device B 168. The one or more messages 166 may be transmitted using a wireless and/or wired connection or link. In some configurations, the one or more messages 166 may be relayed by satellite, base station, routers, switches and/or other devices or mediums to electronic device B 168.

Electronic device B 168 may receive the one or more messages 166 transmitted by electronic device A 102 using a TX/RX block/module 170. The TX/RX block/module 170 may decode, demodulate and/or otherwise deformat the one or more received messages 166 to produce an encoded speech signal 172. The encoded speech signal 172 may comprise, for example, a pitch lag, quantized LPC coefficients and/or quantized gains. The encoded speech signal 172 may be provided to a decoder 174 (e.g., an LPC decoder) that may decode (e.g., synthesize) the encoded speech signal 172 in order to produce a synthesized speech signal 176. The synthesized speech signal 176 may be converted to an acoustic signal (e.g., output) using a transducer (e.g., speaker). It should be noted that electronic device B 168 is not necessary for use of the systems and methods disclosed herein, but is illustrated as part of one possible configuration in which the systems and methods disclosed herein may be used.

In another configuration, the pitch lag 142, the quantized LPC coefficients 116 and/or the quantized gains 158 (e.g., the encoded speech signal) may be provided to a decoder 162 (on electronic device A 102. The decoder 162 may use the pitch lag 142, the quantized LPC coefficients 116 and/or the quantized gains 158 to produce a synthesized speech signal 164. The synthesized speech signal 164 may be output using a speaker, for example. For instance, electronic device A 102 may be a digital voice recorder that encodes and stores speech signals 106 in memory, which may then be decoded to produce a synthesized speech signal 164. The synthesized speech signal 164 may be converted to an acoustic signal (e.g., output) using a transducer (e.g., speaker). It should be noted that the decoder 162 does is not necessary for estimating a pitch lag in accordance with the systems and methods disclosed herein, but is illustrated as part of one possible configuration in which the systems and methods disclosed herein may be used. The decoder 162 on electronic device A 102 and the decoder 174 on electronic device B 168 may perform similar functions.

Figure 2:
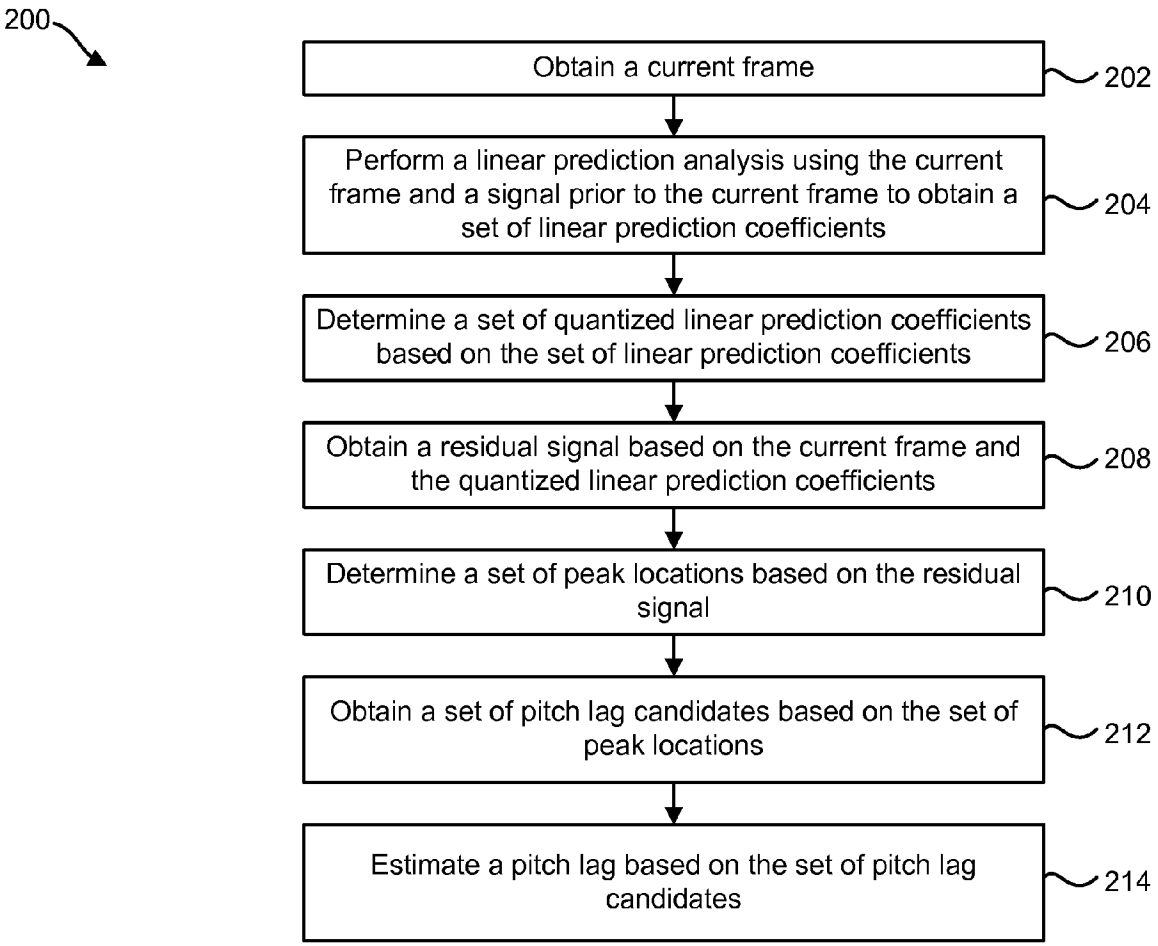
FIG. 2 is a flow diagram illustrating one configuration of a method for estimating a pitch lag.

FIG. 2 is a flow diagram illustrating one configuration of a method 200 for estimating a pitch lag. For example, an electronic device 102 may perform the method 200 illustrated in FIG. 2 in order to estimate a pitch lag in a frame 110 of a speech signal 106. An electronic device 102 may obtain 202 a current frame 110. In one configuration, the electronic device 102 may obtain 202 an electronic speech signal 106 by capturing an acoustic speech signal using a microphone. Additionally or alternatively, the electronic device 102 may receive the speech signal 106 from another device. The electronic device 102 may then segment the speech signal 106 into one or more frames 110. For instance, a frame 110 may include a number of samples with a duration of 10-20 milliseconds.

The electronic device 102 may perform 204 a linear prediction analysis using the current frame 110 and a signal prior to the current frame 110 to obtain a set of linear prediction (e.g., LPC) coefficients 120. For example, the electronic device 102 may use a look-ahead buffer and a buffer containing at least one sample of the speech signal 106 prior to the current speech frame 110 to obtain the LPC coefficients 120.

The electronic device 102 may determine 206 a set of quantized linear prediction (e.g., LPC) coefficients 116 based on the set of LPC coefficients 120. For example, the electronic device 102 may quantize the set of LPC coefficients 120 to determine 206 the set of quantized LPC coefficients 116.

The electronic device 102 may obtain 208 a residual signal 114 based on the current frame 110 and the quantized LPC coefficients 116. For example, the electronic device 102 may remove the effects of the LPC coefficients 116 (e.g., formants) from the frame 110 to obtain 208 the residual signal 114.

The electronic device 102 may determine 210 a set of peak locations based on the residual signal 114. For example, the electronic device may search the LPC residual signal 114 to determine the set of peak locations. A peak location may be described in terms of time and/or sample number, for example.

In one configuration, the electronic device 102 may determine 210 the set of peak locations as follows. The electronic device 102 may calculate an envelope signal based on the absolute value of samples of the (LPC) residual signal 114 and a predetermined window signal. The electronic device 102 may then calculate a first gradient signal based on a difference between the envelope signal and a time-shifted version of the envelope signal. The electronic device 102 may calculate a second gradient signal based on a difference between the first gradient signal and a time-shifted version of the first gradient signal. The electronic device 102 may then select a first set of location indices where a second gradient signal value falls below a predetermined negative threshold. The electronic device 102 may also determine a second set of location indices from the first set of location indices by eliminating location indices where an envelope value falls below a predetermined threshold relative to the largest value in the envelope. Additionally, the electronic device 102 may determine a third set of location indices from the second set of location indices by eliminating location indices that are not a pre-determined difference threshold with respect to neighboring location indices. The location indices (e.g., the first, second and/or third set) may correspond to the location of the determined set of peaks.

The electronic device 102 may obtain 212 a set of pitch lag candidates 132 based on the set of peak locations. For example, the electronic device 102 may arrange the set of peak locations in increasing order to yield an ordered set of peak locations. The electronic device 102 may then calculate distances between consecutive peak location pairs in the ordered set of peak locations. The distances between the consecutive peak location pairs may be the set of pitch lag candidates 132.

In some configurations, the electronic device 102 may add a first approximation pitch lag value that is calculated based on the (LPC) residual signal 114 of the current frame to the set of pitch lag candidates 132. In one example, the electronic device 102 may calculate or estimate the first approximation pitch lag value as follows. The electronic device 102 may estimate an autocorrelation value based on the (LPC) residual signal 114 of the current frame 110. The electronic device 102 may search the autocorrelation value within a predetermined range of locations for a maximum. The electronic device 102 may also set or determine the first approximation pitch lag value as the location at which the maximum occurs. This first approximation pitch lag value may be added to the set of pitch lag candidates 132. The first approximation pitch lag value may be a pitch lag value that is determined by a typical autocorrelation technique of pitch estimation. One example estimation technique can be found in section 4.6.3 of 3GPP2 document C.S0014D titled "Enhanced Variable Rate Codec, Speech Service Options 3, 68, 70, and 73 for Wideband Spread Spectrum Digital Systems."

In some configurations, the electronic device 102 may further add a second approximation pitch lag value that is calculated based on the (LPC) residual signal 114 of a previous frame to the set of pitch lag candidates 132. In one example, the electronic device 102 may calculate or estimate the second approximation pitch lag value as follows. The electronic device 102 may estimate an autocorrelation value based on the (LPC) residual signal 114 of a previous frame 110. The electronic device 102 may search the autocorrelation value within a predetermined range of locations for a maximum. The electronic device 102 may also set or determine the second approximation pitch lag value as the location at which the maximum occurs. The electronic device 102 may add this second approximation pitch lag value to the set of pitch lag candidates 132. The second approximation pitch lag value may be the pitch lag value from the previous frame.

The electronic device 102 may estimate 214 a pitch lag 142 based on the set of pitch lag candidates 132. In one configuration, the electronic device 102 may use a smoothing or averaging algorithm to estimate 214 a pitch lag 142. For example, the pitch lag determination block/module 138 may compute an average of all of the pitch lag candidates 132 to produce the estimated pitch lag 142. In another configuration, the electronic device 102 may use an iterative pruning algorithm 140 to estimate 214 a pitch lag 142. More detail on the iterative pruning algorithm 140 is given below.

The estimated pitch lag 142 may be used to produce a synthesized excitation 150 and/or gain factors 154. Additionally or alternatively, the estimated pitch lag 142 may be stored, transmitted and/or provided to a decoder 162, 174. For instance, a decoder 162, 174 may use the estimated pitch lag 142 to generate a synthesized speech signal 164, 176.

Figure 3:
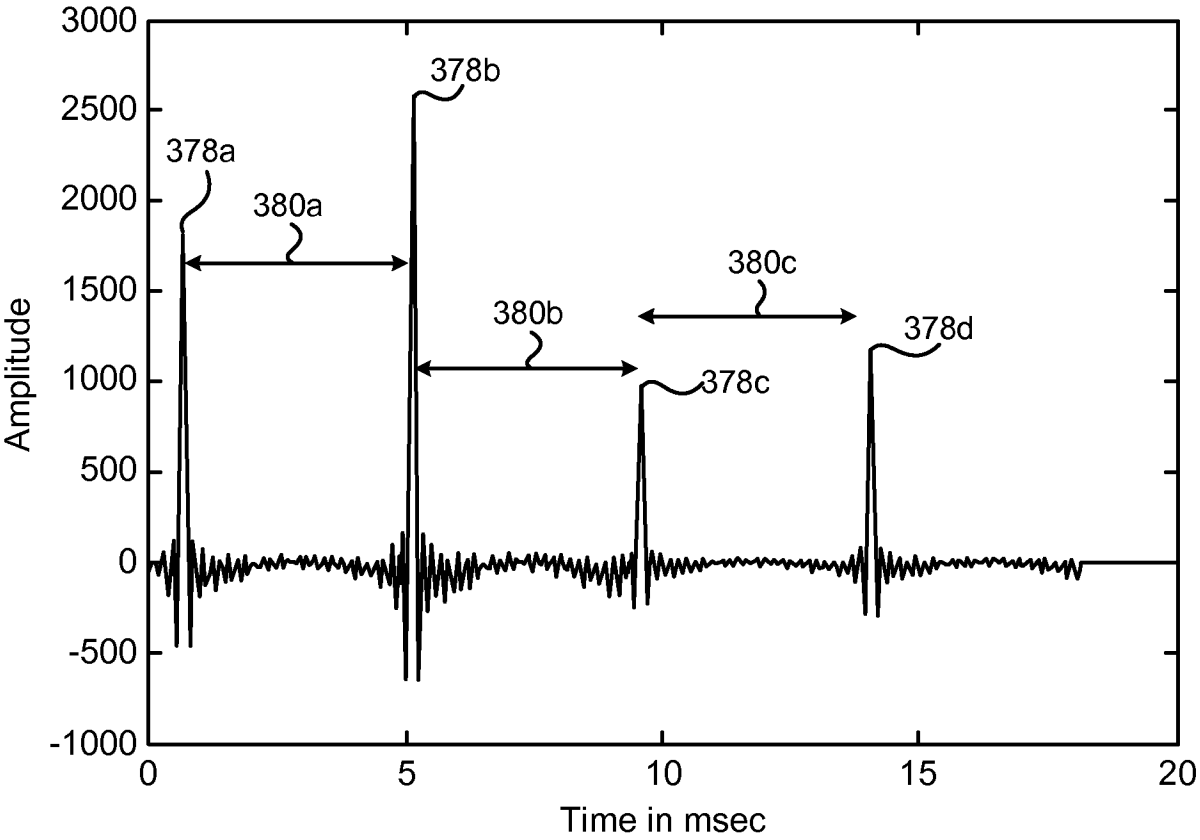
FIG. 3 is a diagram illustrating one example of peaks from a residual signal.

FIG. 3 is a diagram illustrating one example of peaks 378 from a residual signal 114. As described above, an electronic device 102 may use a residual signal 114 to determine a set of peak 378*a* locations from which a set of (inter-peak) distances 380 (e.g., pitch lag candidates 132) may be determined. For example, an electronic device 102 may determine 210 a set of peak locations 378*a-d* as described above in connection with FIG. 2. The electronic device 102 may also determine a set of inter-peak distances 380*a-c* (e.g., pitch lag candidates 132). It should be noted that inter-peak distances 380*a-c* (between consecutive peaks 378, for example) may be specified in units of time or number of samples, for example. In one configuration, the electronic device 102 may obtain 212 a set of pitch lag candidates 132 (e.g., inter-peak distances 380*a-c*) as described above in connection with FIG. 2. The set of inter-peak distances 380*a-c* or pitch lag candidates 132 may be used to estimate a pitch lag. The set of interpeak distances 380*a-c* are illustrated on a set of axes in FIG. 3, where the horizontal axis is illustrated in milliseconds of time and the vertical axis plots the amplitude (e.g., signal amplitudes) of the waveform. For example, the signal amplitude illustrated may be a voltage, current or a pressure variation.

Figure 4:
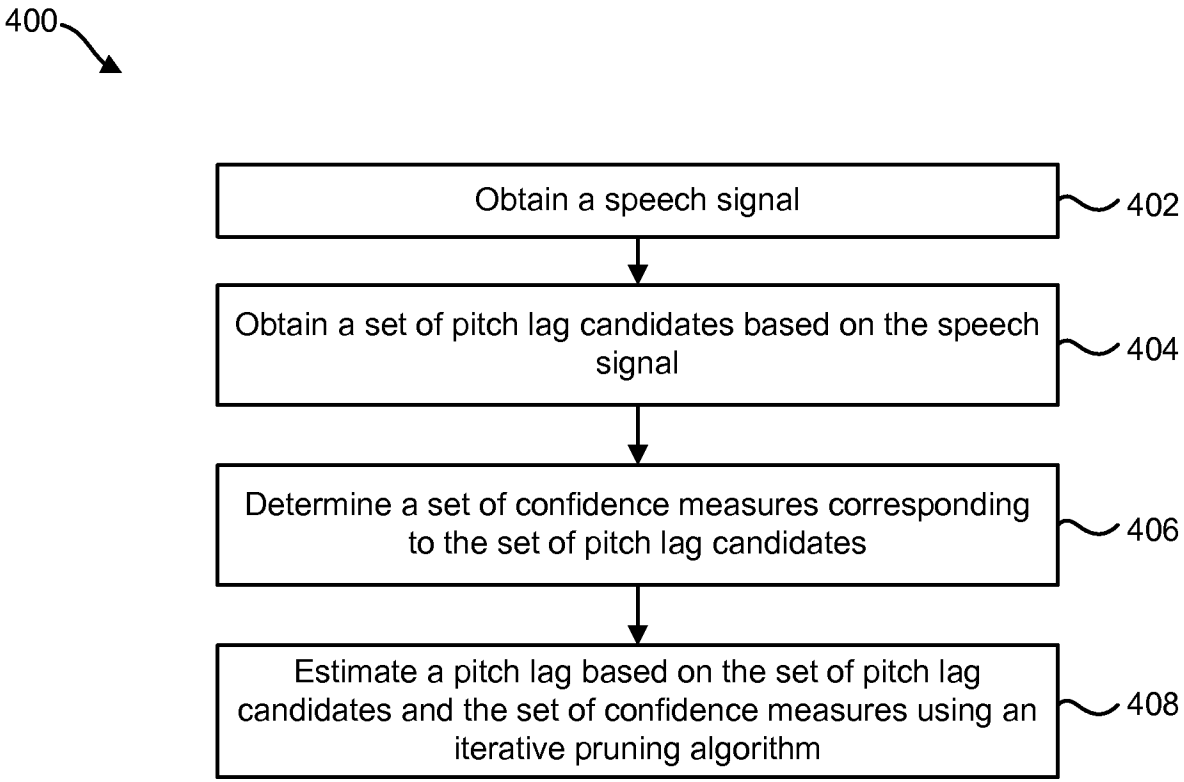
FIG. 4 is a flow diagram illustrating another configuration of a method for estimating a pitch lag.

FIG. 4 is a flow diagram illustrating another configuration of a method 400 for estimating a pitch lag. An electronic device 102 may obtain 402 a speech signal 106. For example, the electronic device 102 may receive the speech signal 106 from another device and/or capture the speech signal 106 using a microphone.

The electronic device 102 may obtain 404 a set of pitch lag candidates based on the speech signal. For example, the electronic device 102 may obtain 404 the set of pitch lag candidates according to any method known in the art. Alternatively, the electronic device 102 may obtain 404 a set of pitch lag candidates 132 in accordance with the systems and methods disclosed herein as described above in connection with FIG. 2.

The electronic device 102 may determine 406 a set of confidence measures 136 corresponding to the set of pitch lag candidates 132. In one example, the set of confidence measures 136 may be a set of correlations. For instance, the electronic device 102 may calculate a set of correlations corresponding to the set of pitch lag candidates 132 based on a signal envelope and consecutive peak location pairs in an ordered set of peak locations. In one configuration, the electronic device 102 may calculate the set of correlations as follows. For each pair of peak locations in the ordered set of peak locations, the electronic device 102 may select a first signal buffer based on a predetermined range around the first peak location in the pair of peak locations. The electronic device 102 may also select a second signal buffer based on a predetermined range around the second peak location in the pair of peak locations. Then, the electronic device 102 may calculate a normalized cross-correlation between the first signal buffer and the second signal buffer. This normalized cross-correlation may be added to the set of confidence measures 136 or correlations. This procedure may be followed for each pair of peak locations in the ordered set of peak locations.

In some configurations, the electronic device 102 may add a first approximation pitch lag value that is calculated based on the (LPC) residual signal 114 of the current frame 110 to the set of pitch lag candidates 132. The electronic device 102 may also add a first pitch gain corresponding to the first approximation pitch lag value to the set of confidence measures 136 or correlations.

In one example, the electronic device 102 may calculate or estimate the first approximation pitch lag value and the corresponding first pitch gain value as follows. The electronic device 102 may estimate an autocorrelation value based on the (LPC) residual signal 114 of the current frame 110. The electronic device 102 may search the autocorrelation value within a predetermined range of locations for a maximum. The electronic device 102 may also set or determine the first approximation pitch lag value as the location at which the maximum occurs and/or set or determine the first pitch gain value as the normalized autocorrelation at the pitch lag.

The electronic device 102 may add a second approximation pitch lag value that is calculated based on the (LPC) residual signal 114 of a previous frame 110 to the set of pitch lag candidates 132. The electronic device 102 may further add a second pitch gain corresponding to the second approximation pitch lag value to the set of confidence measures 136 or correlations.

In one configuration, the electronic device 102 may calculate or estimate the second approximation pitch lag value and the corresponding second pitch gain value as follows. The electronic device 102 may estimate an autocorrelation value based on the (LPC) residual signal 114 of the previous frame 110. The electronic device 102 may search the autocorrelation value within a predetermined range of locations for a maximum. The electronic device 102 may also set or determine the second approximation pitch lag value as the location at which the maximum occurs and/or set or determine the second pitch gain value as the normalized autocorrelation at the pitch lag.

The electronic device 102 may estimate 408 a pitch lag based on the set of pitch lag candidates and the set of confidence measures 136 using an iterative pruning algorithm. In one example of the iterative pruning algorithm, the electronic device 102 may calculate a weighted mean based on the set of pitch lag candidates 132 and the set of confidence measures 136. The electronic device 102 may determine a pitch lag candidate that is farthest from the weighted mean in the set of pitch lag candidates 132. The electronic device 102 may then remove the pitch lag candidate that is farthest from the weighted mean from the set of pitch lag candidates 132. The confidence measure corresponding to the removed pitch lag candidate may be removed from the set of confidence measures 136. This procedure may be repeated until the number of pitch lag candidates 132 remaining is reduced to a designated number. The pitch lag 142 may then be determined based on the one or more remaining pitch lag candidates 132. For example, the last pitch lag candidate remaining may be determined as the pitch lag if only one remains. If more than one pitch lag candidate remains, the electronic device 102 may determine the pitch lag 142 as an average of the remaining candidates, for example.

Figure 5:
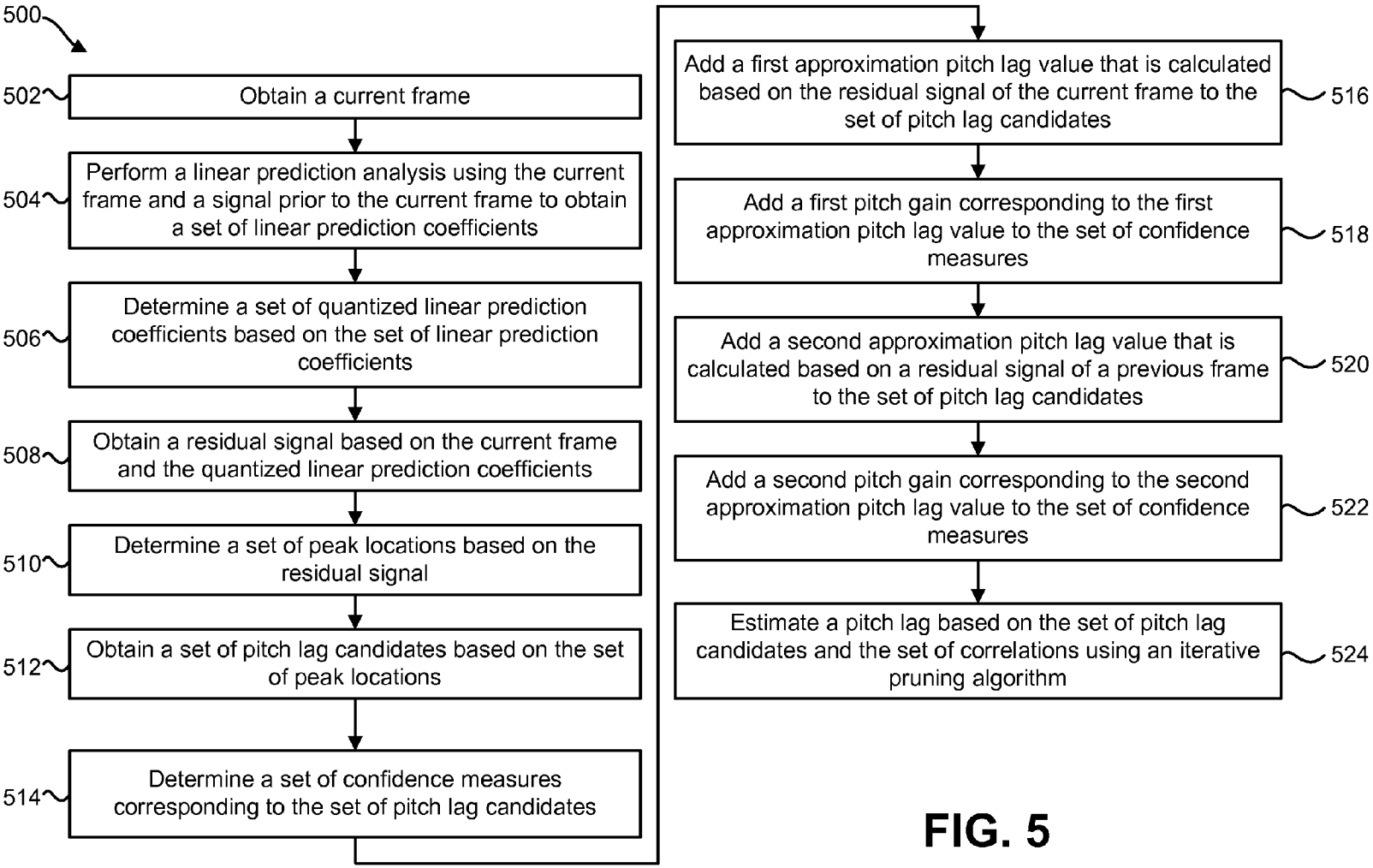
FIG. 5 is a flow diagram illustrating a more specific configuration of a method for estimating a pitch lag.

FIG. 5 is a flow diagram illustrating a more specific configuration of a method 500 for estimating a pitch lag. An electronic device 102 may obtain 502 a current frame 110. In one configuration, the electronic device 102 may obtain 502 an electronic speech signal 106 by capturing an acoustic speech signal using a microphone. Additionally or alternatively, the electronic device 102 may receive the speech signal 106 from another device. The electronic device 102 may then segment the speech signal 106 into one or more frames 110.

The electronic device 102 may perform 504 a linear prediction analysis using the current frame 110 and a signal prior to the current frame 110 to obtain a set of linear prediction (e.g., LPC) coefficients 120. For example, the electronic device 102 may use a look-ahead buffer and a buffer containing at least one sample of the speech signal 106 prior to the current speech frame 110 to obtain the LPC coefficients 120.

The electronic device 102 may determine 506 a set of quantized LPC coefficients 116 based on the set of LPC coefficients 120. For example, the electronic device 102 may quantize the set of LPC coefficients 120 to determine 506 the set of quantized LPC coefficients 116.

The electronic device 102 may obtain 508 a residual signal 114 based on the current frame 110 and the quantized LPC coefficients 116. For example, the electronic device 102 may remove the effects of the LPC coefficients 116 (e.g., formants) from the frame 110 to obtain 508 the residual signal 114.

The electronic device 102 may determine 510 a set of peak locations based on the residual signal 114. For example, the electronic device may search the LPC residual signal 114 to determine the set of peak locations. A peak location may be described in terms of time and/or sample number, for example.

In one configuration, the electronic device 102 may determine 510 the set of peak locations as follows. The electronic device 102 may calculate an envelope signal based on the absolute value of samples of the (LPC) residual signal 114 and a predetermined window signal. The electronic device 102 may then calculate a first gradient signal based on a difference between the envelope signal and a time-shifted version of the envelope signal. The electronic device 102 may calculate a second gradient signal based on a difference between the first gradient signal and a time-shifted version of the first gradient signal. The electronic device 102 may then select a first set of location indices where a second gradient signal value falls below a predetermined negative threshold. The electronic device 102 may also determine a second set of location indices from the first set of location indices by eliminating location indices where an envelope value falls below a predetermined threshold relative to the largest value in the envelope. Additionally, the electronic device 102 may determine a third set of location indices from the second set of location indices by eliminating location indices that are not a pre-determined difference threshold with respect to neighboring location indices. The location indices (e.g., the first, second and/or third set) may correspond to the location of the determined set of peaks.

The electronic device 102 may obtain 512 a set of pitch lag candidates 132 based on the set of peak locations. For example, the electronic device 102 may arrange the set of peak locations in increasing order to yield an ordered set of peak locations. The electronic device 102 may then calculate distances between consecutive peak location pairs in the ordered set of peak locations. The distances between the consecutive peak location pairs may be the set of pitch lag candidates 132.

The electronic device 102 may determine 514 a set of confidence measures 136 corresponding to the set of pitch lag candidates 132. In one example, the set of confidence measures 136 may be may be a set of correlations. For instance, the electronic device 102 may calculate a set of correlations corresponding to the set of pitch lag candidates 132 based on a signal envelope and consecutive peak location pairs in an ordered set of peak locations. In one configuration, the electronic device 102 may calculate the set of correlations as follows. For each pair of peak locations in the ordered set of peak locations, the electronic device 102 may select a first signal buffer based on a predetermined range around the first peak location in the pair of peak locations. The electronic device 102 may also select a second signal buffer based on a predetermined range around the second peak location in the pair of peak locations. Then, the electronic device 102 may calculate a normalized cross-correlation between the first signal buffer and the second signal buffer. This normalized cross-correlation may be added to the set of confidence measures 136 or correlations. This procedure may be followed for each pair of peak locations in the ordered set of peak locations.

The electronic device 102 may add 516 a first approximation pitch lag value that is calculated based on the (LPC) residual signal 114 of the current frame 110 to the set of pitch lag candidates 132. The electronic device 102 may also add 518 a first pitch gain corresponding to the first approximation pitch lag value to the set of confidence measures 136 or correlations.

In one example, the electronic device 102 may calculate or estimate the first approximation pitch lag value and the corresponding first pitch gain value as follows. The electronic device 102 may estimate an autocorrelation value based on the (LPC) residual signal 114 of the current frame 110. The electronic device 102 may search the autocorrelation value within a predetermined range of locations for a maximum. The electronic device 102 may also set or determine the first approximation pitch lag value as the location at which the maximum occurs and/or set or determine the first pitch gain value as the normalized autocorrelation at the pitch lag.

The electronic device 102 may add 520 a second approximation pitch lag value that is calculated based on the (LPC) residual signal 114 of a previous frame 110 to the set of pitch lag candidates 132. The electronic device 102 may further add 522 a second pitch gain corresponding to the second approximation pitch lag value to the set of confidence measures 136 or correlations.

In one configuration, the electronic device 102 may calculate or estimate the second approximation pitch lag value and the corresponding second pitch gain value as follows. The electronic device 102 may estimate an autocorrelation value based on the (LPC) residual signal 114 of the previous frame 110. The electronic device 102 may search the autocorrelation value within a predetermined range of locations for a maximum. The predetermined range of locations can be, for example, 20 to 140, which is a typical range of pitch lag for human speech at an 8 kilohertz (KHz) sampling rate. The electronic device 102 may also set or determine the second approximation pitch lag value as the location at which the maximum occurs and/or set or determine the second pitch gain value as the normalized autocorrelation at the pitch lag.

The electronic device 102 may estimate 524 a pitch lag based on the set of pitch lag candidates 132 and the set of confidence measures 136 using an iterative pruning algorithm 140. In one example of the iterative pruning algorithm 140, the electronic device 102 may calculate a weighted mean based on the set of pitch lag candidates 132 and the set of confidence measures 136. The electronic device 102 may determine a pitch lag candidate that is farthest from the weighted mean in the set of pitch lag candidates 132. The electronic device 102 may then remove the pitch lag candidate that is farthest from the weighted mean from the set of pitch lag candidates 132. The confidence measure corresponding to the removed pitch lag candidate may be removed from the set of confidence measures 136. This procedure may be repeated until the number of pitch lag candidates 132 remaining is reduced to a designated number. The pitch lag 142 may then be determined based on the one or more remaining pitch lag candidates 132. For example, the last pitch lag candidate remaining may be determined as the pitch lag if only one remains. If more than one pitch lag candidate remains, the electronic device 102 may determine the pitch lag 142 as an average of the remaining candidates, for example.

Using the method 500 illustrated in FIG. 5 may be beneficial, particularly for transient frames and other kinds of frames where a traditional pitch lag estimate may not be very accurate. However, the method 500 illustrated in FIG. 5 may be applied to other classes or kinds of frames (e.g., well-behaved voice or speech frames). In some configurations, the method 500 illustrated in FIG. 5 may be selectively applied to certain kinds of frames (e.g., transient and/or noisy frames, etc.).

Figure 6:
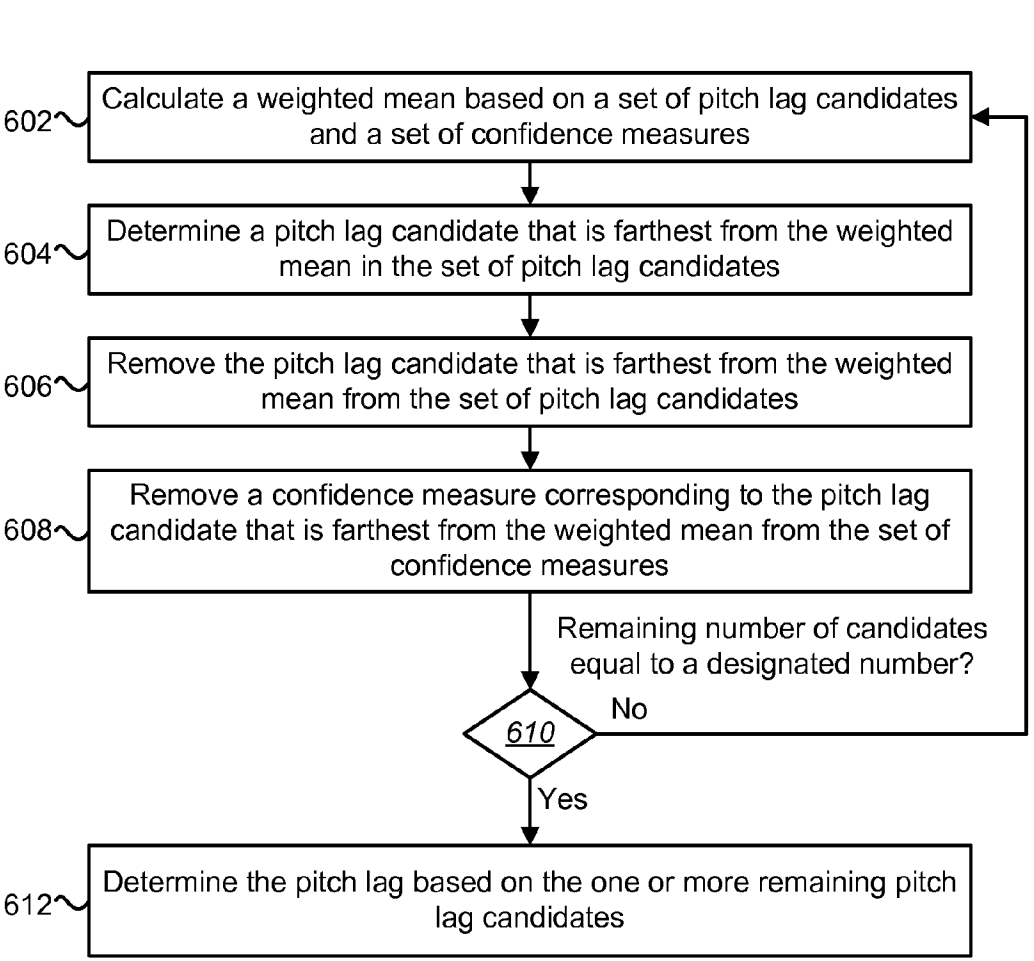
FIG. 6 is a flow diagram illustrating one configuration of a method for estimating a pitch lag using an iterative pruning algorithm.

FIG. 6 is a flow diagram illustrating one configuration of a method 600 for estimating a pitch lag using an iterative pruning algorithm 140. In one configuration, the pruning algorithm 140 may be specified as follows. The pruning algorithm 140 may use a set of pitch lag candidates 132 (denoted $\{d_i\}$) and a set of confidence measures (e.g., correlations) 136 (denoted $\{c_i\}$). i=1, . . . L, where L is a number of pitch lag candidates and L>N. N is a designated number that may represent a desired number pitch lag candidates to be remaining after pruning. In one configuration, N=1.

The electronic device 102 may calculate 602 a weighted mean (denoted $M_w$) based on a set of pitch lag candidates 132 $\{d_i\}$ and a set of confidence measures (e.g., correlations) 136 $\{c_i\}$. This may be done for L candidates as illustrated in Equation (1).

$$M_W = \frac{\sum_{i=1}^{L} d_i c_i}{\sum_{i=1}^{L} c_i} \tag{1}$$

The electronic device 102 may determine 604 a pitch lag candidate (denoted $d_k$) that is farthest from the weighted mean in the set of pitch lag candidates 132. For example, the electronic device 102 may find $d_k$ such that the distance from the mean for $d_k$ is larger than the distance from the mean for all of the other pitch lag candidates. One example of this procedure is illustrated in Equation (2).

Find $d_k$ such that $$|M_w - d_k| > |M_w - d_i| \text{ for all } i,\ i \neq k \tag{2}$$

The electronic device 102 may remove 606 (e.g., "prune") the pitch lag candidate $d_k$ that is farthest from the weighted mean from the set of pitch lag candidates 132 $\{d_i\}$. The electronic device may remove 608 a confidence measure (e.g., correlation) $c_k$ corresponding to the pitch lag candidate that is farthest from the weighted mean from the set of confidence measures (e.g., correlations) 136 $\{c_i\}$. The number of remaining pitch lag candidates (e.g., the value of L) may be reduced by 1 (when a pitch lag candidate is removed 606 from its set 132 and/or when a confidence measure is removed from its set 136, for instance). For example, L=L−1.

The electronic device 102 may determine 610 if the number of remaining pitch lag candidates (e.g., L) is equal to a designated number (e.g., N). For example, the electronic device 102 may determine whether there is/are one or more pitch lag candidates remaining that are equal to the designated number (e.g., L=N=1). If there are more than the designated number of pitch lag candidates remaining, then the electronic device 102 may return to calculating 602 the weighted mean in order to find and remove the candidate that is farthest from the weighted mean. In other words, the first four steps 602, 604, 606, 608 in the method 600 may be iterated or repeated until the number of remaining pitch lag candidates is reduced to the designated number.

If the number of remaining candidates (e.g., L) is equal to the designated number (e.g., N), then the electronic device 102 may determine 612 the pitch lag based on the one or more remaining pitch lag candidates (in the set of pitch lag candidates 132). In the case that the designated number (e.g., N) is one, then the last remaining pitch lag candidate may be determined 612 as the pitch lag 142, for example. In another example, if the designated number (e.g., N) is greater than one, the electronic device 102 may determine 612 the pitch lag 142 as the average of the remaining pitch lag candidates (e.g., average of N remaining pitch lag candidates in the set $\{d_i\}$).

Figure 7:
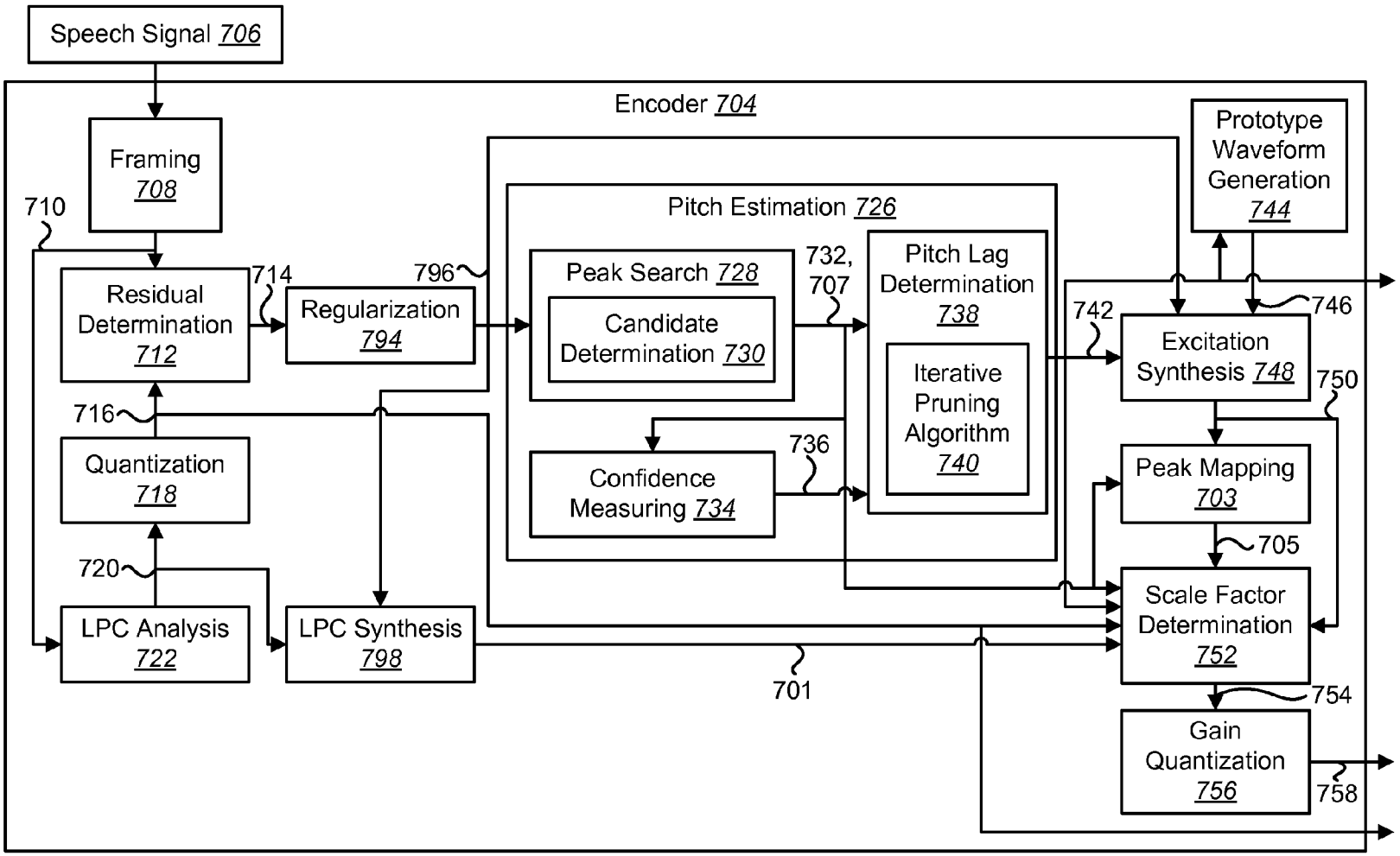
FIG. 7 is a block diagram illustrating one configuration of an encoder in which systems and methods for estimating a pitch lag may be implemented.

FIG. 7 is a block diagram illustrating one configuration of an encoder 704 in which systems and methods for estimating a pitch lag may be implemented. One example of the encoder 704 is a Linear Predictive Coding (LPC) encoder. The encoder 704 may be used by an electronic device to encode a speech signal 706. For instance, the encoder 704 encodes speech signals 706 into a "compressed" format by estimating or generating a set of parameters. In one configuration, such parameters may include a pitch lag 742 (estimate), one or more quantized gains 758 and/or quantized LPC coefficients 716. These parameters may be used to synthesize the speech signal 706.

The encoder 704 may include one or more blocks/modules may be used to estimate a pitch lag according to the systems and methods disclosed herein. In one configuration, these blocks/modules may be referred to as a pitch estimation block/module 726. It should be noted that the pitch estimation block/module 726 may be implemented in a variety of ways. For example, the pitch estimation block/module 726 may comprise a peak search block/module 728, a confidence measuring block/module 734 and/or a pitch lag determination block/module 738. In other configurations, the pitch estimation block/module 726 may omit one or more of these block/modules 728, 734, 738 or replace one or more of them 728, 734, 738 with other blocks/modules. Additionally or alternatively, the pitch estimation block/module 726 may be defined as including other blocks/modules, such as the Linear Predictive Coding (LPC) analysis block/module 722.

In the example illustrated in FIG. 7, the encoder 704 includes a peak search 728 block/module, a confidence measuring block/module 734 and a pitch lag determination block/module 738. However, the peak search block/module 728 and/or the confidence measuring block/module 734 may be optional, and may be replaced with one or more other blocks/modules that determine one or more pitch (e.g., pitch lag) candidates 732 and/or confidence measurements 736.

As illustrated in FIG. 7, the pitch lag determination block/module 738 may use an iterative pruning algorithm 740. However, the iterative pruning algorithm 740 may be optional, and may be omitted in some configurations of the systems and methods disclosed herein. In other words, a pitch lag determination block/module 738 may determine a pitch lag without using an iterative pruning algorithm 740 in some configurations and may use some other approach or algorithm, such as a smoothing or averaging algorithm to determine a pitch lag 742, for example.

A speech signal 706 may be obtained (by an electronic device, for example). The speech signal 706 may be provided to a framing block/module 708. The framing block/module 708 may segment the speech signal 706 into one or more frames 710. For instance, a frame 710 may include a particular number of speech signal 706 samples and/or include an amount of time (e.g., 10-20 milliseconds) of the speech signal 706. When the speech signal 706 is segmented into frames 710, the frames 710 may be classified according to the signal that they contain. For example, a frame 710 may be a voiced frame, an unvoiced frame, a silent frame or a transient frame. The systems and methods disclosed herein may be used to estimate a pitch lag in a frame 710 (e.g., transient frame, voiced frame, etc.).

A transient frame, for example, may be situated on the boundary between one speech class and another speech class. For example, a speech signal 706 may transition from an unvoiced sound (e.g., f, s, sh, th, etc.) to a voiced sound (e.g., a, e, i, o, u, etc.). Some transient types include up transients (when transitioning from an unvoiced to a voiced part of a speech signal 706, for example), plosives, voiced transients (e.g., Linear Predictive Coding (LPC) changes and pitch lag variations) and down transients (when transitioning from a voiced to an unvoiced or silent part of a speech signal 706 such as word endings, for example). A frame 710 in-between the two speech classes may be a transient frame. The systems and methods disclosed herein may be beneficially applied to transient frames, since traditional approaches may not provide accurate pitch lag estimates in transient frames. It should be noted, however, that the systems and methods disclosed herein may be applied to other kinds of frames.

The encoder 704 may use a linear predictive coding (LPC) analysis block/module 722 to perform a linear prediction analysis (e.g., LPC analysis) on a frame 710. It should be noted that the LPC analysis block/module 722 may additionally or alternatively use a signal (e.g., one or more samples) from other frames 710 (from a previous frame 710, for example). The LPC analysis block/module 722 may produce one or more LPC coefficients 720. The LPC coefficients 720 may be provided to a quantization block/module 718 and/or to an LPC synthesis block/module 798.

The quantization block/module 718 may produce one or more quantized LPC coefficients 716. The quantized LPC coefficients 716 may be provided to a scale factor determination block/module 752 and/or may be output from the encoder 704. The quantized LPC coefficients 716 and one or more samples from one or more frames 710 may be provided to a residual determination block/module 712, which may be used to determine a residual signal 714. For example, a residual signal 714 may include a frame 710 of the speech signal 706 that has had the formants or the effects of the formants (e.g., quantized coefficients 716) removed from the speech signal 706 (by the residual determination block/module 712). The residual signal 714 may be provided to a regularization block/module 794.

The regularization block module 794 may regularize the residual signal 714, resulting in a modified (e.g., regularized) residual signal 796. One example of regularization is described in detail in section 4.11.6 of 3GPP2 document C.S0014D titled "Enhanced Variable Rate Codec, Speech Service Options 3, 68, 70, and 73 for Wideband Spread Spectrum Digital Systems." Basically, regularization may move around the pitch pulses in the current frame to line them up with a smoothly evolving pitch coutour. The modified residual signal 796 may be provided to a peak search block/module 728 and/or to an LPC synthesis block/module 798. The LPC synthesis block/module 798 may produce (e.g., synthesize) a modified speech signal 701, which may be provided to the scale factor determination block/module 752.

The peak search block/module 728 may search for peaks in the modified residual signal 796. In other words, the encoder 704 may search for peaks (e.g., regions of high energy) in the modified residual signal 796. These peaks may be identified to obtain a set of peak locations 707. Peak locations in the set of peak locations 707 may be specified in terms of sample number and/or time, for example. In some configurations, the peak search block/module may provide the set of peak locations 707 to one or more blocks/modules, such as the scale factor determination block/module 752 and/or the peak mapping block/module 703. The set of peak locations 707 may represent, for example, the location of "actual" peaks in the modified residual signal 796.

The peak search block/module 728 may include a candidate determination block/module 730. The candidate determination block/module 730 may use the set of peaks in order to determine one or more candidate pitch lags 732. A "pitch lag" may be a "distance" between two successive pitch spikes in a frame 710. A pitch lag may be specified in a number of samples and/or an amount of time, for example. In one configuration, the peak search block/module 728 may determine the distances between peaks in order to determine the pitch lag candidates 732. This may be done, for example, by taking the difference of two peak locations (in time and/or sample number, for instance).

Some traditional methods for estimating the pitch lag use autocorrelation. In those approaches, the LPC residual is slid against itself to do a correlation. Whichever correlation or pitch lag has the largest autocorrelation value may be determined to be the pitch of the frame in those approaches. Those approaches may work when the speech frame is very steady. However, there are other frames where the pitch structure may not be very steady, such as in a transient frame. Even when the speech frame is steady, the traditional approaches may not provide a very accurate pitch estimate due to noise in the system. Noise may reduce how "peaky" the residual is. In such a case, for example, traditional approaches may determine a pitch estimate that is not very accurate.

The peak search block/module 728 may obtain a set of pitch lag candidates 732 using a correlation approach. For example, a set of candidate pitch lags 732 may be first determined by the candidate determination block/module 730. Then, a set of confidence measures 736 corresponding to the set of candidate pitch lags may be determined by the confidence measuring block/module 734 based on the set of pitch lag candidates 732. More specifically, a first set may be a set of pitch lag candidates 732 and a second set may be a set of confidence measures 736 for each of the pitch lag candidates 732. Thus, for example, a first confidence measure or value may correspond to a first pitch lag candidate and so on. Thus, a set of pitch lag candidates 732 and a set of confidence measures 736 may be may be "built" or determined. The set of confidence measures 736 may be used to improve the accuracy of the estimated pitch lag 742. In one configuration, the set of confidence measures 736 may be a set of correlations where each value may be (in basic terms) a correlation at a pitch lag corresponding to a pitch lag candidate. In other words, the correlation coefficient for each particular pitch lag may constitute the confidence measure for each of the pitch lag candidate 732 distances.

In some configurations, the peak search block/module 728 may add a first approximation pitch lag value that is calculated based on the modified residual signal 796 of the current frame 710 to the set of pitch lag candidates 732. The confidence measuring block/module 734 may also add a first pitch gain corresponding to the first approximation pitch lag value to the set of confidence measures 736 or correlations.

In one example, the peak search block/module 728 may calculate or estimate the first approximation pitch lag value as follows. An autocorrelation value may be estimated based on the modified residual signal 796 of the current frame 710. The peak search block/module 728 may search the autocorrelation value within a predetermined range of locations for a maximum. The peak search block/module 728 may also set or determine the first approximation pitch lag value as the location at which the maximum occurs. The first approximation lag may be based on maxima in the autocorrelation function. The first approximation pitch lag value may be added as a pitch lag candidate to the set of pitch lag candidates 732 and/or may be added as a peak location to the set of peak locations 707. The confidence measuring block/module 734 may set or determine the first pitch gain value (e.g., confidence measure) as the normalized autocorrelation at the pitch lag. This may be done based on the first approximation pitch lag value provided by the peak search block/module 728. The first pitch gain value (e.g., confidence measure) may be added to the set of confidence measures 736.

In some configurations, the peak search block/module 728 may add a second approximation pitch lag value that is calculated based on the modified residual signal 796 of a previous frame 710 to the set of pitch lag candidates 732. The confidence measuring block/module 734 may further add a second pitch gain corresponding to the second approximation pitch lag value to the set of confidence measures 736 or correlations.

In one example, the peak search block/module 728 may calculate or estimate the second approximation pitch lag value as follows. An autocorrelation value may be estimated based on the modified residual signal 796 of the previous frame 710. The peak search block/module 728 may search the autocorrelation value within a predetermined range of locations for a maximum. The peak search block/module 728 may also set or determine the second approximation pitch lag value as the location at which the maximum occurs. The second approximation pitch lag value may be the pitch lag value from the previous frame. The second approximation pitch lag value may be added as a pitch lag candidate to the set of pitch lag candidates 732 and/or may be added as a peak location to the set of peak locations 707. The confidence measuring block/module 734 may set or determine the second pitch gain value (e.g., confidence measure) as the normalized autocorrelation at the pitch lag. This may be done based on the second approximation pitch lag value provided by the peak search block/module 728. The second pitch gain value (e.g., confidence measure) may be added to the set of confidence measures 736.

The set of pitch lag candidates 732 and/or the set of confidence measures 736 may be provided to a pitch lag determination block/module 738. The pitch lag determination block/module 738 may determine a pitch lag 742 based on one or more pitch lag candidates 732. In some configurations, the pitch lag determination block/module 738 may determine a pitch lag 742 based on one or more confidence measures 736 (in addition to the one or more pitch lag candidates 732). For example, the pitch lag determination block/module 738 may use an iterative pruning algorithm 740 to select one of the pitch lag values. More detail on the iterative pruning algorithm 740 is given above. The selected pitch lag 742 value may be an estimate of the "true" pitch lag.

In other configurations, the pitch lag determination block/module 738 may use some other approach to determine a pitch lag 742. For example, the pitch lag determination block/module 738 may use an averaging or smoothing algorithm instead of or in addition to the iterative pruning algorithm 740.

The pitch lag 742 determined by the pitch lag determination block/module 738 may be provided to an excitation synthesis block/module 748 and a scale factor determination block/module 752. A modified residual signal 796 from a previous frame 710 may be provided to the excitation synthesis block/module 748. Additionally or alternatively, a waveform 746 may be provided to excitation synthesis block/module 748 by the prototype waveform generation block/module 744. In one configuration, the prototype waveform generation block/module 744 may generate the waveform 746 based on the pitch lag 742. The excitation synthesis block/module 748 may generate or synthesize an excitation 750 based on the pitch lag 742, the (previous frame) modified residual 796 and/or the waveform 746. The synthesized excitation 750 may include locations of peaks in the synthesized excitation.

In one configuration, the prototype waveform generation block/module 744 and/or the excitation synthesis block/module 748 may operate in accordance with Equations (3)-(5). For example, the prototype waveform generation block/module 744 may generate one or more prototype waveforms 746 of length $P_L$ (e.g., the length of the pitch lag 742).

$$mag[i] = \begin{cases} \frac{i}{f_{c_{300}}} & \text{for } 0 \le i \le f_{c_{300}} \\ 1 & \text{for } f_{c_{300}} < i < f_{c_{3500}} \\ 0.1 & \text{for } f_{c_{3500}} < i < \frac{P_L}{2}, \text{ and } mag[P_L - k] = mag[k] \end{cases} \quad (3)$$

In Equation (3), mag is a magnitude coefficient, $P_L$ is a pitch (e.g., a pitch lag estimate 742), $$f_{c_{300}} = \frac{P_L}{40},\ f_{c_{3500}} = \frac{3P_L}{8}$$

and i is an index or sample number.

$$phi[i] = \begin{cases} 0 & \text{for } 0 < i < f_{c_{3500}} \\ \text{random} & \text{for } f_{c_{3500}} < i < \left\lceil \frac{P_L}{2} \right\rceil \end{cases} \quad (4)$$

In Equation (4), phi is a phase coefficient. The mag and phi coefficients may be set in order to generate a prototype waveform 746.

$$\omega(k) = \sum_{j=0}^{P_L} \left( a(j) \times \cos\left(\frac{2\pi}{P_L} \times j \times k\right) + b(j) \times \sin\left(\frac{2\pi}{P_L} \times j \times k\right) \right) \quad (5)$$

In Equation (5), ω(k) is a prototype waveform (e.g., prototype waveform 746), a(j)=mag[j]×cos(phi[j]), b(j)=mag[j]×sin(phi[j]) and k is a segment number.

The synthesized excitation (e.g., synthesized excitation peak locations) 750 may be provided to a peak mapping block/module 703 and/or to the scale factor determination block/module 752. The peak mapping block/module 703 may use a set of peak locations 707 (which may be a set of locations of "true" peaks from the modified residual signal 796) and the synthesized excitation 750 (e.g., locations of peaks in the synthesized excitation 750) to generate a mapping 705. The mapping 705 may be provided to the scale factor determination block/module 752.

The mapping 705, the pitch lag 742, the quantized LPC coefficients 716 and/or the modified speech signal 701 may be provided to the scale factor determination block/module 752. The scale factor determination block/module 752 may produce a set of gains 754 based on the mapping 705, the pitch lag 742, the quantized LPC coefficients 716 and/or the modified speech signal 701. The set of gains 754 may be provided to a gain quantization block/module 756 that quantizes the set of gains 754 to produce a set of quantized gains 758.

The pitch lag 742, the quantized LPC coefficients 716 and/or the quantized gains 758 may be output from the encoder 704. One or more of these pieces of information 742, 716, 758 may be used to decode and/or produce a synthesized speech signal. For example, an electronic device may transmit, store and/or use some or all of the information 742, 716, 758 to decode or synthesize a speech signal. For example, the information 742, 716, 758 may be provided to a transmitter, where they may be formatted (e.g., encoded, modulated, etc.) for transmission to another device. In another example, the information 742, 716, 758 may be stored for later retrieval and/or decoding. A synthesized speech signal based on some or all of the information 742, 716, 758 may be output using a speaker (on the same device as the encoder 704 and/or on a different device).

In one configuration, one or more of the pitch lag 742, the quantized LPC coefficients 716 and/or the quantized gains 758 may be formatted (e.g., encoded) for transmission to another device. For example, some or all of the information 742, 716, 758 may be encoded into corresponding parameters using a number of bits. An "encoding mode indicator" may be an optional parameter that may indicate other encoding modes that may be used, which are described in greater detail in connection with FIGS. 10 and 11 below.

Figure 8:
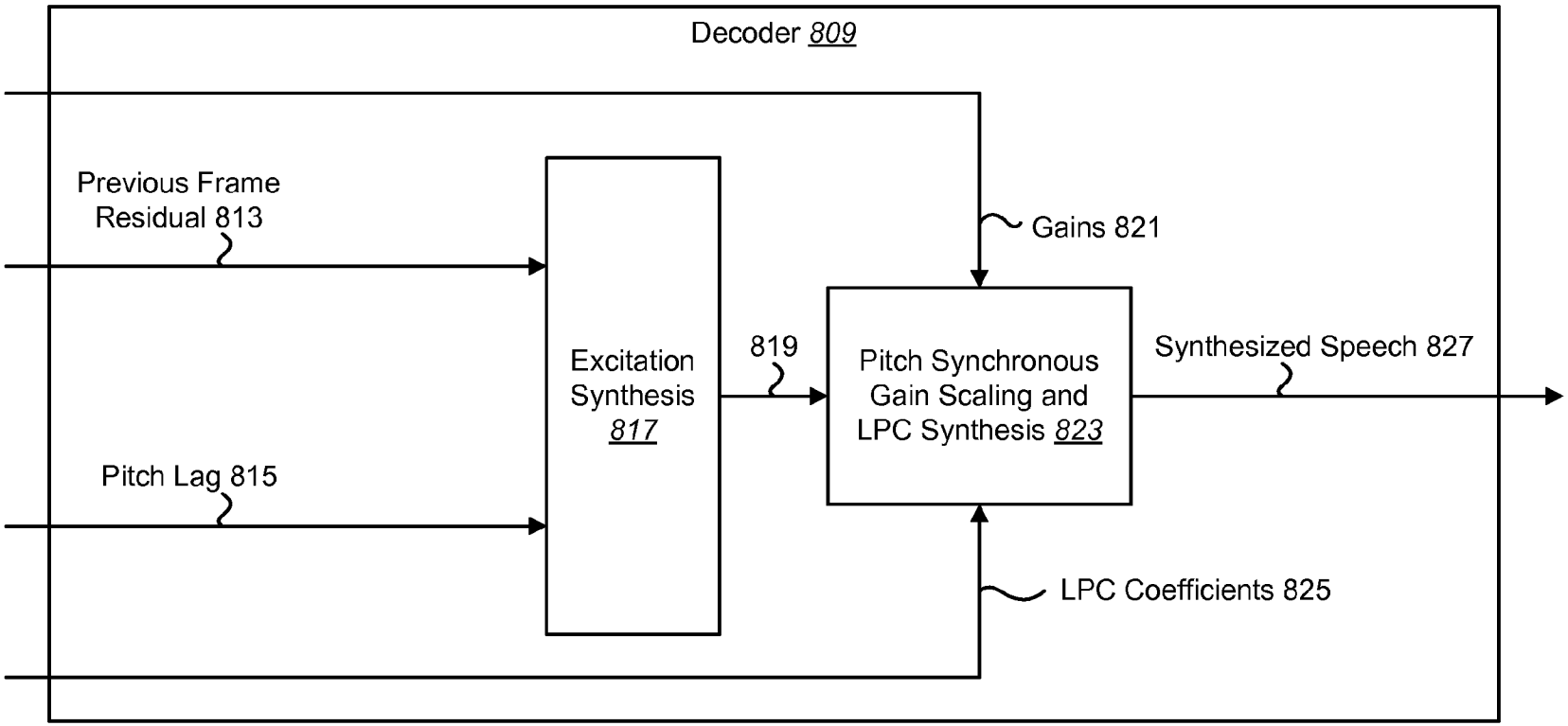
FIG. 8 is a block diagram illustrating one configuration of a decoder.

FIG. 8 is a block diagram illustrating one configuration of a decoder 809. The decoder 809 may include an excitation synthesis block/module 817 and/or a pitch synchronous gain scaling and LPC synthesis block/module 823. In one configuration, the decoder 809 may be located on the same electronic device as an encoder 704. In another configuration, the decoder 809 may be located on an electronic device that is different from an electronic device where an encoder 704 is located.

The decoder 809 may obtain or receive one or more parameters that may be used to generate a synthesized speech signal 827. For example, the decoder 809 may obtain one or more gains 821, a previous frame residual signal 813, a pitch lag 815 and/or one or more LPC coefficients 825.

The previous frame residual 813 may be provided to the excitation synthesis block/module 817. The previous frame residual 813 may be derived from a previously decoded frame. A pitch lag 815 may also be provided to the excitation synthesis block/module 817. The excitation synthesis block/module 817 may synthesize an excitation 819. For example, the excitation synthesis block/module 817 may synthesize a transient excitation 819 based on the previous frame residual 813 and/or the pitch lag 815.

The synthesized excitation 819, the one or more (quantized) gains 821 and/or the one or more LPC coefficients 825 may be provided to the pitch synchronous gain scaling and LPC synthesis block/module 823. The pitch synchronous gain scaling and LPC synthesis block/module 823 may generate a synthesized speech signal 827 based on the synthesized excitation 819, the one or more (quantized) gains 821 and/or the one or more LPC coefficients 825. The synthesized speech signal 827 may be output from the decoder 809. For example, the synthesized speech signal 827 may be stored in memory or output (e.g., converted to an acoustic signal) using a speaker.

Figure 9:
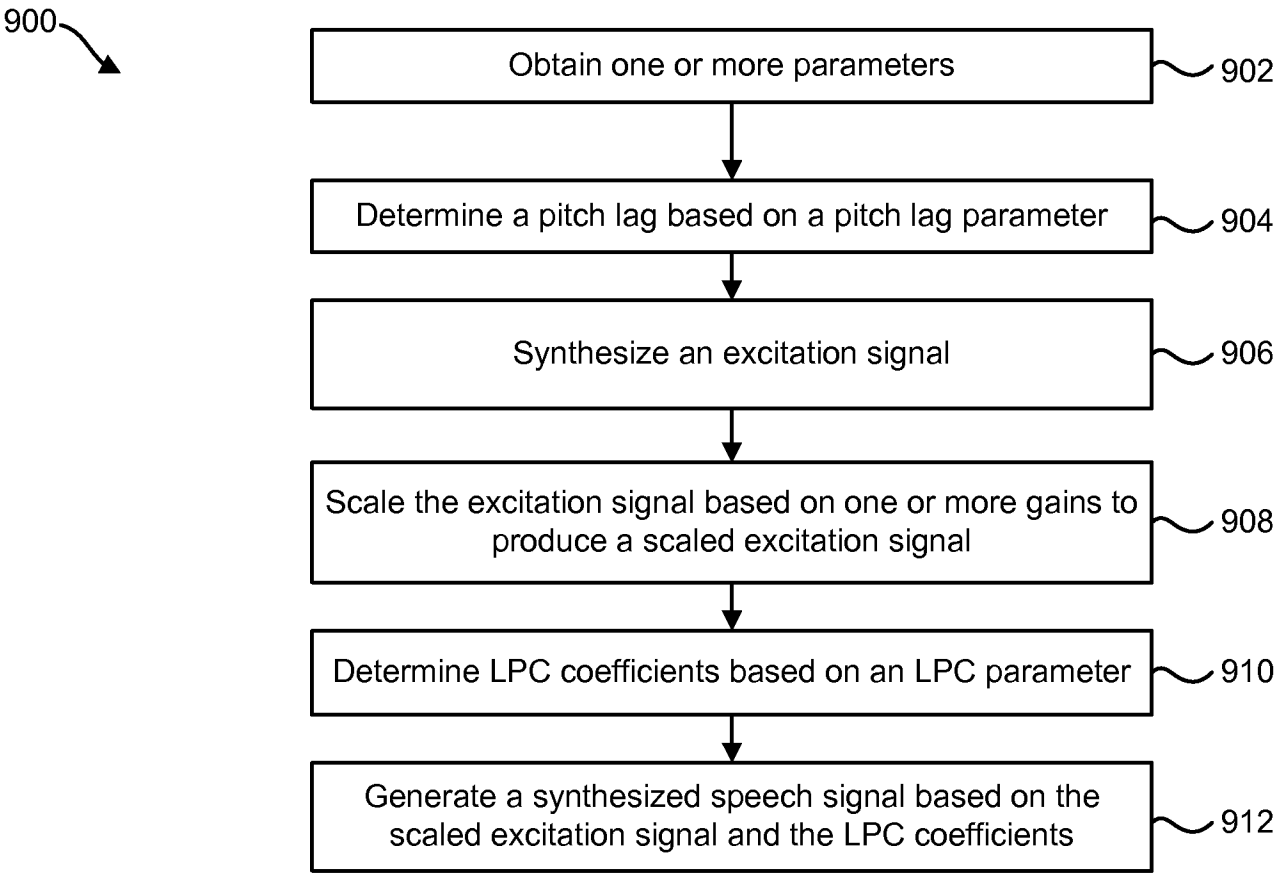
FIG. 9 is a flow diagram illustrating one configuration of a method for decoding a speech signal.

FIG. 9 is a flow diagram illustrating one configuration of a method 900 for decoding a speech signal. An electronic device may obtain 902 one or more parameters. For example, an electronic device may retrieve one or more parameters from memory and/or may receive one or more parameters from another device. For instance, an electronic device may receive a pitch lag parameter, a gain parameter (representing one or more gains), and/or an LPC parameter (representing LPC coefficients 825). Additionally or alternatively, the electronic device may obtain 902 a previous frame residual signal 813.

The electronic device may determine 904 a pitch lag 815 based on a pitch lag parameter. For example, the pitch lag parameter may be represented with 7 bits. The electronic device may use these bits to determine 904 a pitch lag 815 that may be used to synthesize an excitation 819. The electronic device may synthesize 906 an excitation signal 819. The electronic device may scale 908 the excitation signal 819 based on one or more gains 821 (e.g., scaling factors) to produce a scaled excitation signal. For example, the electronic device may amplify and/or attenuate the excitation signal 819 based on the one or more gains 821.

The electronic device may determine 910 one or more LPC coefficients 825 based on an LPC parameter. For example, the LPC parameter may represent LPC coefficients (e.g., line spectral frequencies (LSFs), line spectral pairs (LSPs)) with 18 bits. The electronic device may determine 910 the LPC coefficients 825 based on the 18 bits, for example, by decoding the bits. The electronic device may generate 912 a synthesized speech signal 827 based on the scaled excitation signal 819 and the LPC coefficients 825.

Figure 10:
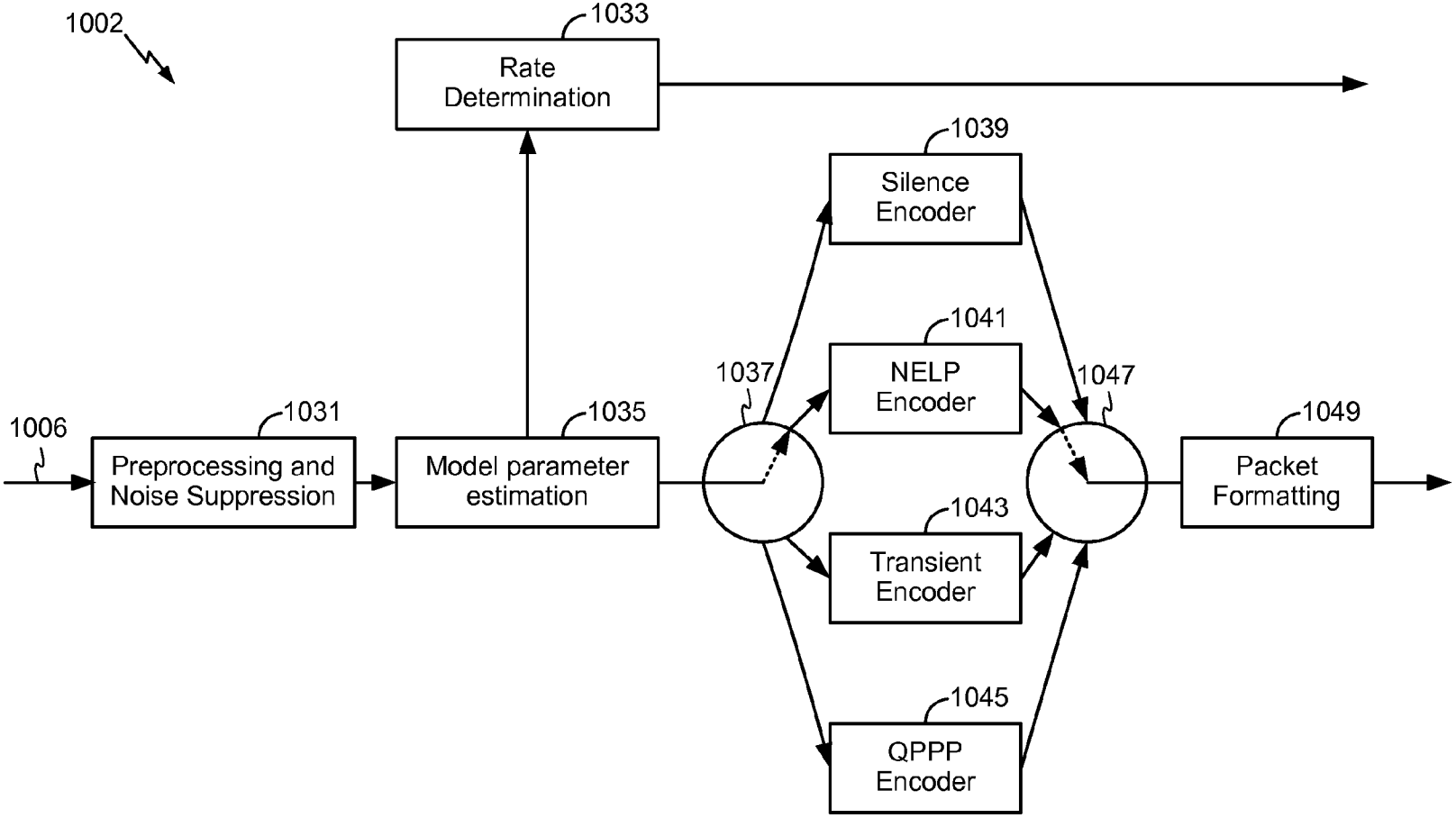
FIG. 10 is a block diagram illustrating one example of an electronic device in which systems and methods for estimating a pitch lag may be implemented.

FIG. 10 is a block diagram illustrating one example of an electronic device 1002 in which systems and methods for estimating a pitch lag may be implemented. In this example, the electronic device 1002 includes a preprocessing and noise suppression block/module 1031, a model parameter estimation block/module 1035, a rate determination block/module 1033, a first switching block/module 1037, a silence encoder 1039, a noise excited (or excitation) linear predictive (or prediction) (NELP) encoder 1041, a transient encoder 1043, a quarter-rate prototype pitch period (QPPP) encoder 1045, a second switching block/module 1047 and a packet formatting block/module 1049.

The preprocessing and noise suppression block/module 1031 may obtain or receive a speech signal 1006. In one configuration, the preprocessing and noise suppression block/module 1031 may suppress noise in the speech signal 1006 and/or perform other processing on the speech signal 1006, such as filtering. The resulting output signal is provided to a model parameter estimation block/module 1035.

The model parameter estimation block/module 1035 may estimate LPC coefficients through linear prediction analysis, estimate a first approximation pitch lag and estimate the autocorrelation at the first approximation pitch lag. The rate determination block/module 1033 may determine a coding rate for encoding the speech signal 1006. The coding rate may be provided to a decoder for use in decoding the (encoded) speech signal 1006.

The electronic device 1002 may determine which encoder to use for encoding the speech signal 1006. It should be noted that, at times, the speech signal 1006 may not always contain actual speech, but may contain silence and/or noise, for example. In one configuration, the electronic device 1002 may determine which encoder to use based on the model parameter estimation 1035. For example, if the electronic device 1002 detects silence in the speech signal 1006, it 1002 may use the first switching block/module 1037 to channel the (silent) speech signal through the silence encoder 1039. The first switching block/module 1037 may be similarly used to switch the speech signal 1006 for encoding by the NELP encoder 1041, the transient encoder 1043 or the QPPP encoder 1045, based on the model parameter estimation 1035.

The silence encoder 1039 may encode or represent the silence with one or more pieces of information. For instance, the silence encoder 1039 could produce a parameter that represents the length of silence in the speech signal 1006.

The "noise-excited linear predictive" (NELP) encoder 1041 may be used to code frames classified as unvoiced speech. NELP coding operates effectively, in terms of signal reproduction, where the speech signal 1006 has little or no pitch structure. More specifically, NELP may be used to encode speech that is noise-like in character, such as unvoiced speech or background noise. NELP uses a filtered pseudo-random noise signal to model unvoiced speech. The noise-like character of such speech segments can be reconstructed by generating random signals at the decoder and applying appropriate gains to them. NELP may use a simple model for the coded speech, thereby achieving a lower bit rate.

The transient encoder 1043 may be used to encode transient frames in the speech signal 1006 in accordance with the systems and methods disclosed herein. For example, the encoders 104, 704 described in connection with FIGS. 1 and 7 above may be used as the transient encoder 1043. Thus, for example, the electronic device 1002 may use the transient encoder 1043 to encode the speech signal 1006 when a transient frame is detected.

The quarter-rate prototype pitch period (QPPP) encoder 1045 may be used to code frames classified as voiced speech. Voiced speech contains slowly time varying periodic components that are exploited by the QPPP encoder 1045. The QPPP encoder 1045 codes a subset of the pitch periods within each frame. The remaining periods of the speech signal 1006 are reconstructed by interpolating between these prototype periods. By exploiting the periodicity of voiced speech, the QPPP encoder 1045 is able to reproduce the speech signal 1006 in a perceptually accurate manner.

The QPPP encoder 1045 may use Prototype Pitch Period Waveform Interpolation (PPPWI), which may be used to encode speech data that is periodic in nature. Such speech is characterized by different pitch periods being similar to a "prototype" pitch period (PPP). This PPP may be voice information that the QPPP encoder 1045 uses to encode. A decoder can use this PPP to reconstruct other pitch periods in the speech segment.

The second switching block/module 1047 may be used to channel the (encoded) speech signal from the encoder 1039, 1041, 1043, 1045 that is currently in use to the packet formatting block/module 1049. The packet formatting block/module 1049 may format the (encoded) speech signal 1006 into one or more packets (for transmission, for example). For instance, the packet formatting block/module 1049 may format a packet for a transient frame. In one configuration, the one or more packets produced by the packet formatting block/module 1049 may be transmitted to another device.

Figure 11:
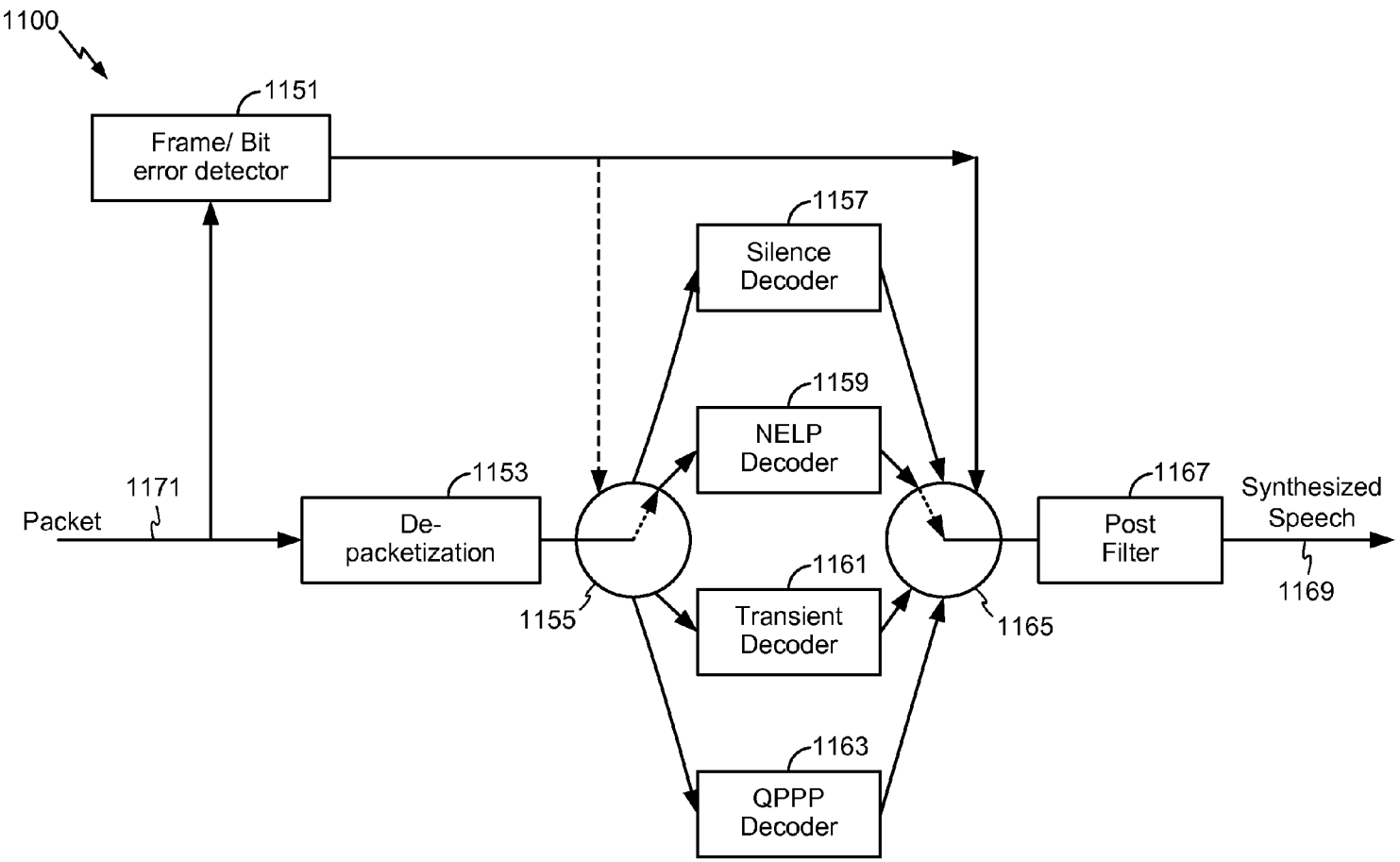
FIG. 11 is a block diagram illustrating one example of an electronic device in which systems and methods for decoding a speech signal may be implemented.

FIG. 11 is a block diagram illustrating one example of an electronic device 1100 in which systems and methods for decoding a speech signal may be implemented. In this example, the electronic device 1100 includes a frame/bit error detector 1151, a de-packetization block/module 1153, a first switching block/module 1155, a silence decoder 1157, a noise excited linear predictive (NELP) decoder 1159, a transient decoder 1161, a quarter-rate prototype pitch period (QPPP) decoder 1163, a second switching block/module 1165 and a post filter 1167.

The electronic device 1100 may receive a packet 1171. The packet 1171 may be provided to the frame/bit error detector 1151 and the de-packetization block/module 1153. The de-packetization block/module 1153 may "unpack" information from the packet 1171. For example, a packet 1171 may include header information, error correction information, routing information and/or other information in addition to payload data. The de-packetization block/module 1153 may extract the payload data from the packet 1171. The payload data may be provided to the first switching block/module 1155.

The frame/bit error detector 1151 may detect whether part or all of the packet 1171 was received incorrectly. For example, the frame/bit error detector 1151 may use an error detection code (sent with the packet 1171) to determine whether any of the packet 1171 was received incorrectly. In some configurations, the electronic device 1100 may control the first switching block/module 1155 and/or the second switching block/module 1165 based on whether some or all of the packet 1171 was received incorrectly, which may be indicated by the frame/bit error detector 1151 output.

Additionally or alternatively, the packet 1171 may include information that indicates which type of decoder should be used to decode the payload data. For example, an encoding electronic device 1002 may send two bits that indicate the encoding mode. The (decoding) electronic device 1100 may use this indication to control the first switching block/module 1155 and the second switching block/module 1165.

The electronic device 1100 may thus use the silence decoder 1157, the NELP decoder 1159, the transient decoder 1161 or the QPPP decoder 1163 to decode the payload data from the packet 1171. The decoded data may then be provided to the second switching block/module 1165, which may route the decoded data to the post filter 1167. The post filter 1167 may perform some filtering on the decoded data and output a synthesized speech signal 1169.

In one example, the packet 1171 may indicate (with the encoding mode indicator) that a silence encoder 1039 was used to encode the payload data. The electronic device 1100 may control the first switching block/module 1155 to route the payload data to the silence decoder 1157. The decoded (silent) payload data may then be provided to the second switching block/module 1165, which may route the decoded payload data to the post filter 1167. In another example, the NELP decoder 1159 may be used to decode a speech signal (e.g., unvoiced speech signal) that was encoded by a NELP encoder 1041.

In yet another example, the packet 1171 may indicate that the payload data was encoded using a transient encoder 1043 (using an encoding mode indicator, for example). Thus, the electronic device 1100 may use the first switching block/module 1155 to route the payload data to the transient decoder 1161. The transient decoder 1161 may decode the payload data as described above. In another example, the QPPP decoder 1163 may be used to decode a speech signal (e.g., voiced speech signal) that was encoded by a QPPP encoder 1045.

The decoded data may be provided to the second switching block/module 1165, which may route it to the post filter 1167. The post filter 1167 may perform some filtering on the signal, which may be output as a synthesized speech signal 1169. The synthesized speech signal 1169 may then be stored, output (using a speaker, for example) and/or transmitted to another device (e.g., a Bluetooth headset).

Figure 12:
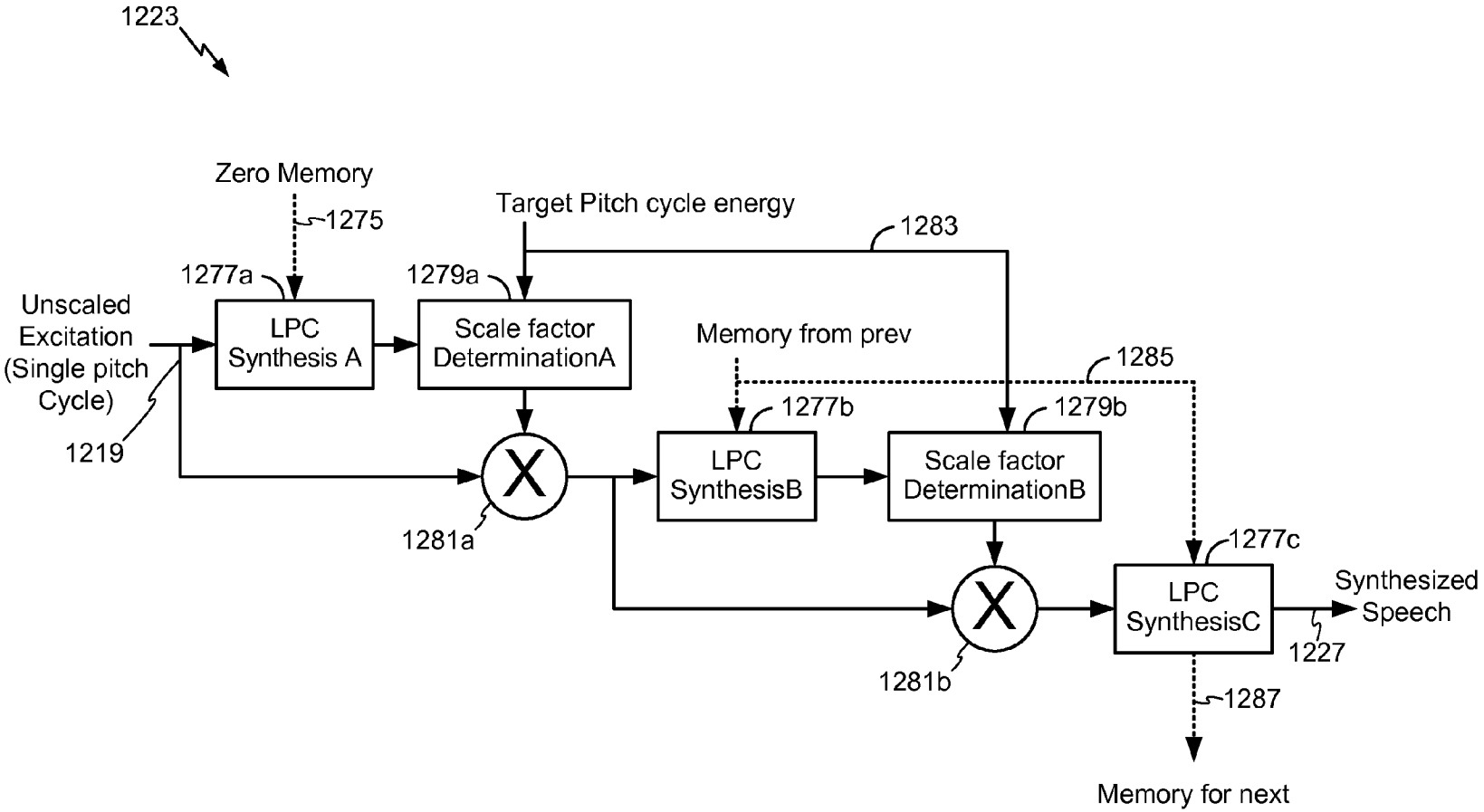
FIG. 12 is a block diagram illustrating one configuration of a pitch synchronous gain scaling and LPC synthesis block/module.

FIG. 12 is a block diagram illustrating one configuration of a pitch synchronous gain scaling and LPC synthesis block/module 1223. The pitch synchronous gain scaling and LPC synthesis block/module 1223 illustrated in FIG. 12 may be one example of a pitch synchronous gain scaling and LPC synthesis block/module 823 shown in FIG. 8. As illustrated in FIG. 12, a pitch synchronous gain scaling and LPC synthesis block/module 1223 may include one or more LPC synthesis blocks/modules 1277*a-c*, one or more scale factor determination blocks/modules 1279*a-b* and/or one or more multipliers 1281*a-b*.

LPC synthesis block/module A 1277*a* may obtain or receive an unsealed excitation 1219 (for a single pitch cycle, for example). Initially, LPC synthesis block/module A 1277*a* may also use zero memory 1275. The output of LPC synthesis block/module A 1277*a* may be provided to scale factor determination block/module A 1279*a*. Scale factor determination block/module A 1279*a* may use the output from LPC synthesis A 1277*a* and a target pitch cycle energy input 1283 to produce a first scaling factor, which may be provided to a first multiplier 1281*a*. The multiplier 1281*a* multiplies the unsealed excitation signal 1219 by the first scaling factor. The (scaled) excitation signal or first multiplier 1281*a* output is provided to LPC synthesis block/module B 1277*b* and a second multiplier 1281*b*.

LPC synthesis block/module B 1277*b* uses the first multiplier 1281*a* output as well as a memory input 1285 (from previous operations) to produce a synthesized output that is provided to scale factor determination block/module B 1279*b*. For example, the memory input 1285 may come from the memory at the end of the previous frame. Scale factor determination block/module B 1279*b* uses the LPC synthesis block/module B 1277*b* output in addition to the target pitch cycle energy input 1283 in order to produce a second scaling factor, which is provided to the second multiplier 1281*b*. The second multiplier 1281*b* multiplies the first multiplier 1281*a* output (e.g., the scaled excitation signal) by the second scaling factor. The resulting product (e.g., the excitation signal that has been scaled a second time) is provided to LPC synthesis block/module C 1277*c*. LPC synthesis block/module C 1277*c* uses the second multiplier 1281*b* output in addition to the memory input 1285 to produce a synthesized speech signal 1227 and memory 1287 for further operations.

Figure 13:
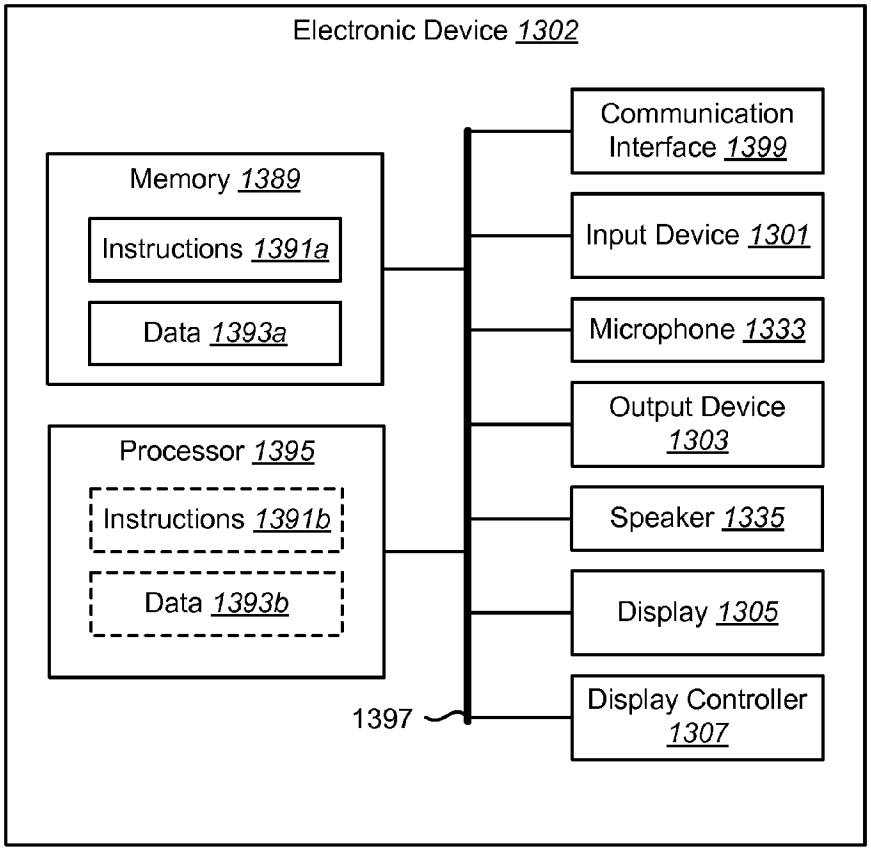
FIG. 13 illustrates various components that may be utilized in an electronic device.

FIG. 13 illustrates various components that may be utilized in an electronic device 1302. The illustrated components may be located within the same physical structure or in separate housings or structures. The electronic devices 102, 168, 1002, 1100 discussed previously may be configured similarly to the electronic device 1302. The electronic device 1302 includes a processor 1395. The processor 1395 may be a general purpose single- or multi-chip microprocessor (e.g., an ARM), a special purpose microprocessor (e.g., a digital signal processor (DSP)), a microcontroller, a programmable gate array, etc. The processor 1395 may be referred to as a central processing unit (CPU). Although just a single processor 1395 is shown in the electronic device 1302 of FIG. 13, in an alternative configuration, a combination of processors (e.g., an ARM and DSP) could be used.

The electronic device 1302 also includes memory 1389 in electronic communication with the processor 1395. That is, the processor 1395 can read information from and/or write information to the memory 1389. The memory 1389 may be any electronic component capable of storing electronic information. The memory 1389 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1393*a* and instructions 1391*a* may be stored in the memory 1389. The instructions 1391*a* may include one or more programs, routines, sub-routines, functions, procedures, etc. The instructions 1391*a* may include a single computer-readable statement or many computer-readable statements. The instructions 1391*a* may be executable by the processor 1395 to implement the methods 200, 400, 500, 600, 900 described above. Executing the instructions 1391*a* may involve the use of the data 1393*a* that is stored in the memory 1389. FIG. 13 shows some instructions 1391*b* and data 1393*b* being loaded into the processor 1395 (which may come from instructions 1391*a* and data 1393*a*).

The electronic device 1302 may also include one or more communication interfaces 1399 for communicating with other electronic devices. The communication interfaces 1399 may be based on wired communication technology, wireless communication technology, or both. Examples of different types of communication interfaces 1399 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 1302 may also include one or more input devices 1301 and one or more output devices 1303. Examples of different kinds of input devices 1301 include a keyboard, mouse, microphone, remote control device, button, joystick, trackball, touchpad, lightpen, etc. For instance, the electronic device 1302 may include one or more microphones 1333 for capturing acoustic signals. In one configuration, a microphone 1333 may be a transducer that converts acoustic signals (e.g., voice, speech) into electrical or electronic signals. Examples of different kinds of output devices 1303 include a speaker, printer, etc. For instance, the electronic device 1302 may include one or more speakers 1335. In one configuration, a speaker 1335 may be a transducer that converts electrical or electronic signals into acoustic signals. One specific type of output device which may be typically included in an electronic device 1302 is a display device 1305. Display devices 1305 used with configurations disclosed herein may utilize any suitable image projection technology, such as a cathode ray tube (CRT), liquid crystal display (LCD), light-emitting diode (LED), gas plasma, electroluminescence, or the like. A display controller 1307 may also be provided, for converting data stored in the memory 1389 into text, graphics, and/or moving images (as appropriate) shown on the display device 1305.

The various components of the electronic device 1302 may be coupled together by one or more buses, which may include a power bus, a control signal bus, a status signal bus, a data bus, etc. For simplicity, the various buses are illustrated in FIG. 13 as a bus system 1397. It should be noted that FIG. 13 illustrates only one possible configuration of an electronic device 1302. Various other architectures and components may be utilized.

Figure 14:
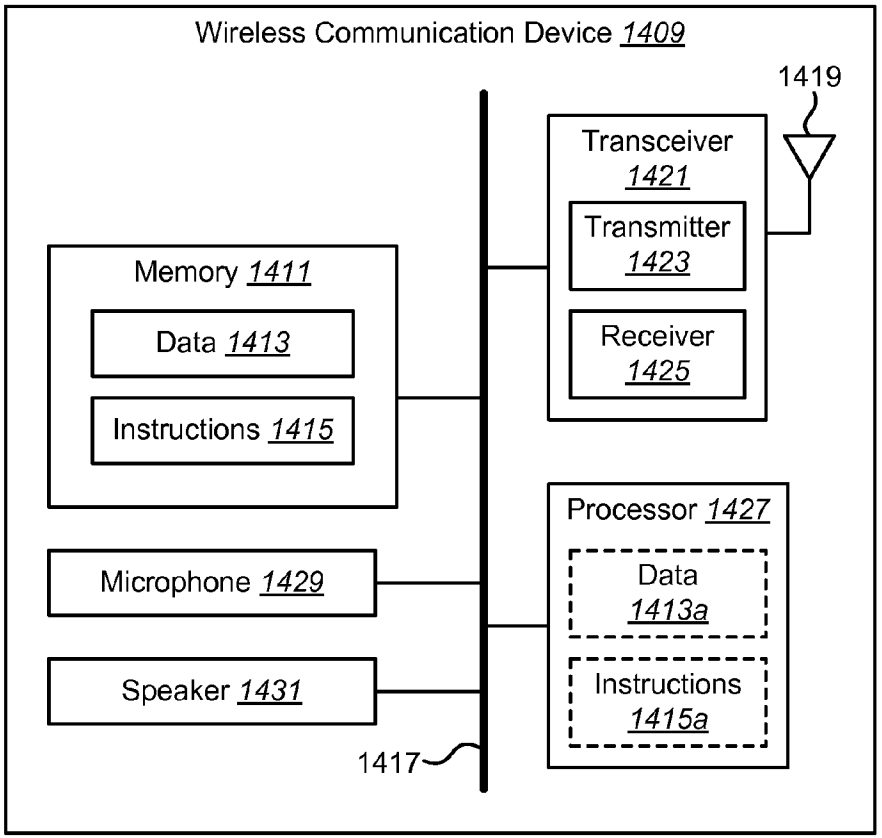
FIG. 14 illustrates certain components that may be included within a wireless communication device.

FIG. 14 illustrates certain components that may be included within a wireless communication device 1409. The electronic devices 102, 168, 1002, 1100 described above may be configured similarly to the wireless communication device 1409 that is shown in FIG. 14.

The wireless communication device 1409 includes a processor 1427. The processor 1427 may be a general purpose single- or multi-chip microprocessor (e.g., an ARM), a special purpose microprocessor (e.g., a digital signal processor (DSP)), a microcontroller, a programmable gate array, etc. The processor 1427 may be referred to as a central processing unit (CPU). Although just a single processor 1427 is shown in the wireless communication device 1409 of FIG. 14, in an alternative configuration, a combination of processors (e.g., an ARM and DSP) could be used.

The wireless communication device 1409 also includes memory 1411 in electronic communication with the processor 1427 (i.e., the processor 1427 can read information from and/or write information to the memory 1411). The memory 1411 may be any electronic component capable of storing electronic information. The memory 1411 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1413 and instructions 1415 may be stored in the memory 1411. The instructions 1415 may include one or more programs, routines, sub-routines, functions, procedures, code, etc. The instructions 1415 may include a single computer-readable statement or many computer-readable statements. The instructions 1415 may be executable by the processor 1427 to implement the methods 200, 400, 500, 600, 900 described above. Executing the instructions 1415 may involve the use of the data 1413 that is stored in the memory 1411. FIG. 14 shows some instructions 1415*a* and data 1413*a* being loaded into the processor 1427 (which may come from instructions 1415 and data 1413).

The wireless communication device 1409 may also include a transmitter 1423 and a receiver 1425 to allow transmission and reception of signals between the wireless communication device 1409 and a remote location (e.g., another electronic device, communication device, etc.). The transmitter 1423 and receiver 1425 may be collectively referred to as a transceiver 1421. An antenna 1419 may be electrically coupled to the transceiver 1421. The wireless communication device 1409 may also include (not shown) multiple transmitters, multiple receivers, multiple transceivers and/or multiple antenna.

In some configurations, the wireless communication device 1409 may include one or more microphones 1429 for capturing acoustic signals. In one configuration, a microphone 1429 may be a transducer that converts acoustic signals (e.g., voice, speech) into electrical or electronic signals. Additionally or alternatively, the wireless communication device 1409 may include one or more speakers 1431. In one configuration, a speaker 1431 may be a transducer that converts electrical or electronic signals into acoustic signals.

The various components of the wireless communication device 1409 may be coupled together by one or more buses, which may include a power bus, a control signal bus, a status signal bus, a data bus, etc. For simplicity, the various buses are illustrated in FIG. 14 as a bus system 1417.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. An electronic device for estimating a pitch lag, comprising:

a processor;

memory in electronic communication with the processor;

instructions stored in the memory, the instructions being executable to:

obtain a current frame of a digital speech signal;

obtain a residual signal based on the current frame;

determine a set of peak locations based on the residual signal, wherein determining the set of peak locations comprises calculating an envelope signal based on samples of the residual signal and a window signal, calculating a first gradient signal based on a difference between the envelope signal and a time-shifted version of the envelope signal, calculating a second gradient signal based on a difference between the first gradient signal and a time-shifted version of the first gradient signal, and selecting a first set of location indices where a second gradient signal value falls below a first threshold;

obtain a set of pitch lag candidates based on the set of peak locations by determining a distance between peak locations within the current frame; and estimate a pitch lag based on the set of pitch lag candidates.

2. The electronic device of claim 1, wherein determining the set of peak locations further comprises:

determining a second set of location indices from the first set of location indices by eliminating location indices where an envelope value falls below a second threshold relative to a largest value in the envelope; and determining a third set of location indices from the second set of location indices by eliminating location indices that do not meet a difference threshold with respect to neighboring location indices.

3. The electronic device of claim 1, wherein obtaining the set of pitch lag candidates comprises:

arranging the set of peak locations in increasing order to yield an ordered set of peak locations; and calculating a distance between consecutive peak location pairs in the ordered set of peak locations.

4. The electronic device of claim 1, wherein the instructions are further executable to:

perform a linear prediction analysis using the current frame and a signal prior to the current frame to obtain a set of linear prediction coefficients; and determine a set of quantized linear prediction coefficients based on the set of linear prediction coefficients.

5. The electronic device of claim 4, wherein obtaining the residual signal is further based on the set of quantized linear prediction coefficients.

6. The electronic device of claim 1, wherein the instructions are further executable to calculate a set of confidence measures corresponding to the set of pitch lag candidates.

7. The electronic device of claim 6, wherein calculating the set of confidence measures corresponding to the set of pitch lag candidates is based on a signal envelope and consecutive peak location pairs in an ordered set of the peak locations.

8. The electronic device of claim 7, wherein calculating the set of confidence measures comprises, for each pair of peak locations in the ordered set of the peak locations:

selecting a first signal buffer based on a range around a first peak location in a pair of peak locations;

selecting a second signal buffer based on a range around a second peak location in the pair of peak locations;

calculating a normalized cross-correlation between the first signal buffer and the second signal buffer; and adding the normalized cross-correlation to the set of confidence measures.

9. The electronic device of claim 6, wherein the pitch lag is estimated based on the set of pitch lag candidates and the set of confidence measures using an iterative pruning algorithm.

10. The electronic device of claim 6, wherein the instructions are further executable to:

add a first approximation pitch lag value that is calculated based on the residual signal of the current frame to the set of pitch lag candidates; and add a first pitch gain corresponding to the first approximation pitch lag value to the set of confidence measures.

11. The electronic device of claim 10, wherein the first approximation pitch lag value is estimated and the first pitch gain is estimated by:

estimating an autocorrelation value based on the residual signal of the current frame;

searching the autocorrelation value within a range of locations for a maximum;

setting the first approximation pitch lag value as a location at which the maximum occurs; and setting the first pitch gain value as a normalized autocorrelation at the first approximation pitch lag value.

12. The electronic device of claim 10, wherein the instructions are further executable to:

add a second approximation pitch lag value that is calculated based on a residual signal of a previous frame to the set of pitch lag candidates; and add a second pitch gain corresponding to the second approximation pitch lag value to the set of confidence measures.

13. The electronic device of claim 12, wherein the second approximation pitch lag value is estimated and the second pitch gain is estimated by:

estimating an autocorrelation value based on the residual signal of the previous frame;

searching the autocorrelation value within a range of locations for a maximum;

setting the second approximation pitch lag value as the location at which the maximum occurs; and setting the pitch gain value as a normalized autocorrelation at the second approximation pitch lag value.

14. The electronic device of claim 9, wherein estimating the pitch lag based on the set of pitch lag candidates and the set of confidence measures using an iterative pruning algorithm comprises:

calculating a weighted mean using the set of pitch lag candidates and the set of confidence measures;

determining a pitch lag candidate that is farthest from the weighted mean in the set of pitch lag candidates;

removing the pitch lag candidate that is farthest from the weighted mean from the set of pitch lag candidates;

removing a confidence measure corresponding to the pitch lag candidate that is farthest from the weighted mean from the set of confidence measures;

determining whether a remaining number of pitch lag candidates is equal to a designated number; and determining the pitch lag based on one or more remaining pitch lag candidates if the remaining number of pitch lag candidates is equal to the designated number.

15. The electronic device of claim 14, wherein the instructions are further executable to iterate if the remaining number of pitch lag candidates is not equal to the designated number.

16. The electronic device of claim 14, wherein calculating the weighted mean is accomplished according to an equation $$M_W = \frac{\sum_{i=1}^{L} d_i c_i}{\sum_{i=1}^{L} c_i},$$

wherein $M_w$ is the weighted mean, L is a number of pitch lag candidates, $\{d_i\}$ is the set of pitch lag candidates and $\{c_i\}$ is the set of confidence measures.

17. The electronic device of claim 14, wherein determining a pitch lag candidate that is farthest from the weighted mean in the set of pitch lag candidates is accomplished by finding a $d_k$ such that $|M_w-d_k|>|M_w-d_i|$ for all i, where $i\neq k$, wherein $d_k$ is the pitch lag candidate that is farthest from the weighted mean, $M_w$ is the weighted mean, $\{d_i\}$ is the set of pitch lag candidates and i is an index number.

18. The electronic device of claim 1, wherein the instructions are further executable to transmit the pitch lag.

19. The electronic device of claim 1, wherein the electronic device is a wireless communication device.

20. An electronic device for estimating a pitch lag, comprising:

a processor;

memory in electronic communication with the processor;

instructions stored in the memory, the instructions being executable to:

obtain a speech signal;

obtain a set of pitch lag candidates based on the speech signal;

determine a set of confidence measures corresponding to the set of pitch lag candidates; and estimate a pitch lag based on the set of pitch lag candidates and the set of confidence measures using an iterative pruning algorithm that removes a pitch lag candidate based on a weighted mean and recalculates the weighted mean, wherein the weighted mean is calculated using the set of pitch lag candidates and the set of confidence measures.

21. The electronic device of claim 20, wherein estimating the pitch lag based on the set of pitch lag candidates and the set of confidence measures using an iterative pruning algorithm further comprises:

determining a pitch lag candidate that is farthest from a weighted mean in the set of pitch lag candidates;

removing a pitch lag candidate that is farthest from the weighted mean from the set of pitch lag candidates;

removing a confidence measure corresponding to the pitch lag candidate that is farthest from the weighted mean from the set of confidence measures;

determining whether a remaining number of pitch lag candidates is equal to a designated number; and determining the pitch lag based on one or more remaining pitch lag candidates if the remaining number of pitch lag candidates is equal to the designated number.

22. A method for estimating a pitch lag on an electronic device, comprising:

obtaining a current frame of a digital speech signal;

obtaining a residual signal based on the current frame;

determining a set of peak locations based on the residual signal, wherein determining the set of peak locations comprises calculating an envelope signal based on samples of the residual signal and a window signal, calculating a first gradient signal based on a difference between the envelope signal and a time-shifted version of the envelope signal, calculating a second gradient signal based on a difference between the first gradient signal and a time-shifted version of the first gradient signal, and selecting a first set of location indices where a second gradient signal value falls below a first threshold;

obtaining a set of pitch lag candidates based on the set of peak locations by determining a distance between peak locations within the current frame; and estimating a pitch lag based on the set of pitch lag candidates.

23. The method of claim 22, wherein determining the set of peak locations further comprises:

determining a second set of location indices from the first set of location indices by eliminating location indices where an envelope value falls below a second threshold relative to a largest value in the envelope; and determining a third set of location indices from the second set of location indices by eliminating location indices that do not meet a difference threshold with respect to neighboring location indices.

24. The method of claim 22, wherein obtaining the set of pitch lag candidates comprises:

arranging the set of peak locations in increasing order to yield an ordered set of peak locations; and calculating a distance between consecutive peak location pairs in the ordered set of peak locations.

25. The method of claim 22, further comprising:

performing a linear prediction analysis using the current frame and a signal prior to the current frame to obtain a set of linear prediction coefficients; and determining a set of quantized linear prediction coefficients based on the set of linear prediction coefficients.

26. The method of claim 25, wherein obtaining the residual signal is further based on the set of quantized linear prediction coefficients.

27. The method of claim 22, further comprising calculating a set of confidence measures corresponding to the set of pitch lag candidates.

28. The method of claim 27, wherein calculating the set of confidence measures corresponding to the set of pitch lag candidates is based on a signal envelope and consecutive peak location pairs in an ordered set of the peak locations.

29. The method of claim 28, wherein calculating the set of confidence measures comprises, for each pair of peak locations in the ordered set of the peak locations:

selecting a first signal buffer based on a range around a first peak location in a pair of peak locations;

selecting a second signal buffer based on a range around a second peak location in the pair of peak locations;

calculating a normalized cross-correlation between the first signal buffer and the second signal buffer; and adding the normalized cross-correlation to the set of confidence measures.

30. The method of claim 27, wherein the pitch lag is estimated based on the set of pitch lag candidates and the set of confidence measures using an iterative pruning algorithm.

31. The method of claim 27, further comprising:

adding a first approximation pitch lag value that is calculated based on the residual signal of the current frame to the set of pitch lag candidates; and adding a first pitch gain corresponding to the first approximation pitch lag value to the set of confidence measures.

32. The method of claim 31, wherein the first approximation pitch lag value is estimated and the first pitch gain is estimated by:

estimating an autocorrelation value based on the residual signal of the current frame;

searching the autocorrelation value within a range of locations for a maximum;

setting the first approximation pitch lag value as a location at which the maximum occurs; and setting the first pitch gain value as a normalized autocorrelation at the first approximation pitch lag value.

33. The method of claim 31, further comprising:

adding a second approximation pitch lag value that is calculated based on a residual signal of a previous frame to the set of pitch lag candidates; and adding a second pitch gain corresponding to the second approximation pitch lag value to the set of confidence measures.

34. The method of claim 33, wherein the second approximation pitch lag value is estimated and the second pitch gain is estimated by:

estimating an autocorrelation value based on the residual signal of the previous frame;

searching the autocorrelation value within a range of locations for a maximum;

setting the second approximation pitch lag value as the location at which the maximum occurs; and setting the pitch gain value as a normalized autocorrelation at the second approximation pitch lag value.

35. The method of claim 30, wherein estimating the pitch lag based on the set of pitch lag candidates and the set of confidence measures using an iterative pruning algorithm comprises:

calculating a weighted mean using the set of pitch lag candidates and the set of confidence measures;

determining a pitch lag candidate that is farthest from the weighted mean in the set of pitch lag candidates;

removing the pitch lag candidate that is farthest from the weighted mean from the set of pitch lag candidates;

removing a confidence measure corresponding to the pitch lag candidate that is farthest from the weighted mean from the set of confidence measures;

determining whether a remaining number of pitch lag candidates is equal to a designated number; and determining the pitch lag based on one or more remaining pitch lag candidates if the remaining number of pitch lag candidates is equal to the designated number.

36. The method of claim 35, further comprising iterating if the remaining number of pitch lag candidates is not equal to the designated number.

37. The method of claim 35, wherein calculating the weighted mean is accomplished according to an equation $$M_W = \frac{\sum_{i=1}^{L} d_i c_i}{\sum_{i=1}^{L} c_i},$$

wherein $M_w$ is the weighted mean, L is a number of pitch lag candidates, $\{d_i\}$ is the set of pitch lag candidates and $\{c_i\}$ is the set of confidence measures.

38. The method of claim 35, wherein determining a pitch lag candidate that is farthest from the weighted mean in the set of pitch lag candidates is accomplished by finding a $d_k$ such that $|M_w-d_k|>|M_w-d_i|$ for all i, where $i\neq k$, wherein $d_k$ is the pitch lag candidate that is farthest from the weighted mean, $M_w$ is the weighted mean, $\{d_i\}$ is the set of pitch lag candidates and i is an index number.

39. The method of claim 22, further comprising transmitting the pitch lag.

40. The method of claim 22, wherein the electronic device is a wireless communication device.

41. A method for estimating a pitch lag on an electronic device, comprising:

obtaining a speech signal;

obtaining a set of pitch lag candidates based on the speech signal;

determining a set of confidence measures corresponding to the set of pitch lag candidates; and estimating a pitch lag based on the set of pitch lag candidates and the set of confidence measures using an iterative pruning algorithm that removes a pitch lag candidate based on a weighted mean and recalculates the weighted mean, wherein the weighted mean is calculated using the set of pitch lag candidates and the set of confidence measures.

42. The method of claim 41, wherein estimating the pitch lag based on the set of pitch lag candidates and the set of confidence measures using an iterative pruning algorithm further comprises:

determining a pitch lag candidate that is farthest from a weighted mean in the set of pitch lag candidates;

removing a pitch lag candidate that is farthest from the weighted mean from the set of pitch lag candidates;

removing a confidence measure corresponding to the pitch lag candidate that is farthest from the weighted mean from the set of confidence measures;

determining whether a remaining number of pitch lag candidates is equal to a designated number; and determining the pitch lag based on one or more remaining pitch lag candidates if the remaining number of pitch lag candidates is equal to the designated number.

43. A computer-program product for estimating a pitch lag, comprising a non-transitory tangible computer-readable medium having instructions thereon, the instructions comprising:

code for causing an electronic device to obtain a current frame of a digital speech signal;

code for causing the electronic device to obtain a residual signal based on the current frame;

code for causing the electronic device to determine a set of peak locations based on the residual signal, wherein the code for determining the set of peak locations comprises code for calculating an envelope signal based on samples of the residual signal and a window signal, code for calculating a first gradient signal based on a difference between the envelope signal and a time-shifted version of the envelope signal, code for calculating a second gradient signal based on a difference between the first gradient signal and a time-shifted version of the first gradient signal, and code for selecting a first set of location indices where a second gradient signal value falls below a first threshold;

code for causing the electronic device to obtain a set of pitch lag candidates based on the set of peak locations by determining a distance between peak locations within the current frame; and code for causing the electronic device to estimate a pitch lag based on the set of pitch lag candidates.

44. The computer-program product of claim 43, wherein the code for causing the electronic device to determine the set of peak locations further comprises:

code for causing the electronic device to determine a second set of location indices from the first set of location indices by eliminating location indices where an envelope value falls below a second threshold relative to a largest value in the envelope; and code for causing the electronic device to determine a third set of location indices from the second set of location indices by eliminating location indices that do not meet a difference threshold with respect to neighboring location indices.

45. A computer-program product for estimating a pitch lag, comprising a non-transitory tangible computer-readable medium having instructions thereon, the instructions comprising:

code for causing an electronic device to obtain a speech signal;

code for causing the electronic device to obtain a set of pitch lag candidates based on the speech signal;

code for causing the electronic device to determine a set of confidence measures corresponding to the set of pitch lag candidates; and code for causing the electronic device to estimate a pitch lag based on the set of pitch lag candidates and the set of confidence measures using an iterative pruning algorithm that removes a pitch lag candidate based on a weighted mean and recalculates the weighted mean, wherein the weighted mean is calculated using the set of pitch lag candidates and the set of confidence measures.

46. The computer-program product of claim 45, wherein the code for causing the electronic device to estimate the pitch lag based on the set of pitch lag candidates and the set of confidence measures using an iterative pruning algorithm comprises:

code for causing the electronic device to determine a pitch lag candidate that is farthest from a weighted mean in the set of pitch lag candidates;

code for causing the electronic device to remove a pitch lag candidate that is farthest from the weighted mean from the set of pitch lag candidates;

code for causing the electronic device to remove a confidence measure corresponding to the pitch lag candidate that is farthest from the weighted mean from the set of confidence measures;

code for causing the electronic device to determine whether a remaining number of pitch lag candidates is equal to a designated number; and code for causing the electronic device to determine the pitch lag based on one or more remaining pitch lag candidates if the remaining number of pitch lag candidates is equal to the designated number.

47. An apparatus for estimating a pitch lag, comprising:

means for obtaining a current frame of a digital speech signal;

means for obtaining a residual signal based on the current frame;

means for determining a set of peak locations based on the residual signal, wherein the means for determining the set of peak locations comprises means for calculating an envelope signal based on samples of the residual signal and a window signal, means for calculating a first gradient signal based on a difference between the envelope signal and a time-shifted version of the envelope signal, means for calculating a second gradient signal based on a difference between the first gradient signal and a time-shifted version of the first gradient signal, and means for selecting a first set of location indices where a second gradient signal value falls below a first threshold;

means for obtaining a set of pitch lag candidates based on the set of peak locations by determining a distance between peak locations within the current frame; and means for estimating a pitch lag based on the set of pitch lag candidates.

48. The apparatus of claim 47, wherein the means for determining the set of peak locations further comprises:

means for determining a second set of location indices from the first set of location indices by eliminating location indices where an envelope value falls below a second threshold relative to a largest value in the envelope; and means for determining a third set of location indices from the second set of location indices by eliminating location indices that do not meet a difference threshold with respect to neighboring location indices.

49. An apparatus for estimating a pitch lag, comprising:

means for obtaining a speech signal;

means for obtaining a set of pitch lag candidates based on the speech signal;

means for determining a set of confidence measures corresponding to the set of pitch lag candidates; and means for estimating a pitch lag based on the set of pitch lag candidates and the set of confidence measures using an iterative pruning algorithm that removes a pitch lag candidate based on a weighted mean and recalculates the weighted mean, wherein the weighted mean is calculated using the set of pitch lag candidates and the set of confidence measures.

50. The apparatus of claim 49, wherein the means for estimating the pitch lag based on the set of pitch lag candidates and the set of confidence measures using an iterative pruning algorithm further comprises:

means for determining a pitch lag candidate that is farthest from a weighted mean in the set of pitch lag candidates;

means for removing a pitch lag candidate that is farthest from the weighted mean from the set of pitch lag candidates;

means for removing a confidence measure corresponding to the pitch lag candidate that is farthest from the weighted mean from the set of confidence measures;

means for determining whether a remaining number of pitch lag candidates is equal to a designated number; and means for determining the pitch lag based on one or more remaining pitch lag candidates if the remaining number of pitch lag candidates is equal to the designated number.

* * * * *